US005514531A

United States Patent [19]

Shono et al.

[11] Patent Number: 5,514,531

[45] **Date of Patent: * May 7, 1996**

[54] SILVER HALIDE COLOR PHOTOGRAPHIC MATERIAL

[75] Inventors: Akiko Shono; Nobuo Seto, both of Minami-ashigara, Japan

[73] Assignee: Fuji Photo Film Co., Ltd., Kanagawa, Japan

[ * ] Notice: The portion of the term of this patent subsequent to Dec. 15, 2012, has been disclaimed.

[21] Appl. No.: 254,425

[22] Filed: Jun. 6, 1994

Related U.S. Application Data

[63] Continuation of Ser. No. 866,453, Apr. 10, 1992, abandoned.

[30] Foreign Application Priority Data

| | | | |
|---|---|---|---|
| Apr. 12, 1991 | [JP] | Japan | 3-108800 |
| Jun. 25, 1991 | [JP] | Japan | 3-180422 |
| Oct. 21, 1991 | [JP] | Japan | 3-299499 |

[51] Int. Cl.[6] ..... G03C 7/36; G03C 1/34

[52] U.S. Cl. ..... 430/551; 430/556; 430/557

[58] Field of Search ..... 430/558, 551, 430/556, 557

[56] References Cited

U.S. PATENT DOCUMENTS

| | | | |
|---|---|---|---|
| 4,268,591 | 5/1981 | Tschopp | 430/17 |
| 4,797,350 | 1/1989 | Ohbayashi et al. | 430/551 |
| 4,820,614 | 4/1989 | Takada et al. | 430/551 |
| 4,863,840 | 9/1989 | Komorita et al. | 430/551 |
| 5,017,464 | 5/1991 | Nishijima et al. | 430/551 |
| 5,118,599 | 6/1992 | Lau et al. | 430/556 |
| 5,427,902 | 6/1995 | Shimura et al. | 430/556 |

*Primary Examiner*—Lee C. Wright

*Attorney, Agent, or Firm*—Birch, Stewart, Kolasch & Birch

[57] ABSTRACT

There is disclosed a silver halide color photographic material which comprises an acylacetamide yellow dye-forming coupler represented by the following formula (I) and a compound represented by the following formula (II) or (III):

Formula (I)

wherein $R_1$ represents a monovalent group, Q represents a group of non-metallic atoms required to form together with the C a 3- to 5-membered cyclic hydrocarbon group or a 3- to 5-membered heterocyclic group, and $Y_R$ represents a residue remaining after removing the acyl group from the acylacetamide yellow dye-forming coupler represented by formula (I), provided that $R_1$ is not a hydrogen atom and does not bond to Q to form a ring, Formula (II)

wherein $R_{a1}$, $R_{a2}$, $R_{a3}$, $R_{a4}$, and $R_{a5}$ each represent a hydrogen atom, or a substituent such as an alkyl group, an alkenyl group, an aryl group, a heterocyclic group, a cyano group, a halogen atom, or a nitro group, provided that $R_{a1}$, $R_{a2}$, $R_{a3}$, $R_{a4}$, and $R_{a5}$ are not hydrogen atoms at the same time, Formula (III)

wherein $R_3$ represents a hydrogen atom, or a substituent such as —$OR_4$ in which $R_4$ represents a hydrogen atom or an alkyl group, an oxy radical, $R_5'$ and $R_5''$ each represent an alkyl group; B represents a group of non-metallic atoms required to form together with the nitrogen atom a 5- to 7-membered ring.

12 Claims, No Drawings

SILVER HALIDE COLOR PHOTOGRAPHIC MATERIAL

This is a continuation, of application Ser. No. 07/866,453 filed on Apr. 10, 1992, now abandoned.

FIELD OF THE INVENTION

The present invention relates to a silver halide color photographic material, and more particularly to a silver halide color photographic material improved in color-forming property, color reproduction, and preservability of the dye image.

BACKGROUND OF THE INVENTION

In silver halide color photographic materials, generally a yellow coupler, a magenta coupler, and a cyan coupler are used in combination as photographic couplers that will react with the oxidized product of an aromatic primary amine developing agent to form color-formed dyes.

For the color-formed dyes obtained from such couplers, the following properties are desired: for example, they are desired to be fine in spectral absorption characteristics and high in fastness, for example, to light, heat, and humidity. The "fine spectral absorption characteristics" desired for photographic materials means that each of the color-formed dyes respectively formed from couplers does not have undesired absorption in the wavelength region other than the desired main absorption. For example, in the case of yellow color formed dyes, since the main absorption section of the formed dyes are broad, there is undesired absorption on the long-wavelength side of the maximum absorption wavelength and color reproduction of yellow and green hues is unsatisfactory.

In color photographic materials used for recording and preserving images, conventionally, benzoylacetanilide yellow couplers or bivaloylacetaminlide yellow couplers have been used. However, the yellow dyes obtained from these couplers have a problem in view of color reproduction because the main absorption is broad, and therefore a technique for improving them has been desired. Further, since the color-formed dyes obtained from the above yellow couplers are poorer in fastness than the color-formed dyes obtained from magenta couplers and cyan couplers, the change in color balance during storage is conspicuous and therefore its improvement in color print materials that are particularly intended to be kept for a long period of time has been strongly desired.

Therefore, in order to improve light-fastness of such yellow color-formed dyes, sterically hindered phenol compounds described, for example, in JP-A ("JP-A" means unexamined published Japanese patent application) Nos. 48535/1979 and 222853/1985; polyalkylpiperidine compounds described, for example, in JP-B ("JP-B" means examined Japanese patent publication) No. 20617/1982 and JP-A Nos. 116747/1984 and 11935/1984; and compounds described, for example, in JP-A Nos. 239149/1987, 240965/1987, 254149/1987, 262047/1987, and 300748/1990, are known. Certainly, light-fastness was improved by the use of a combination of a yellow coupler and these compounds. However, it was found, for example, that the color-forming property of the coupler was deteriorated.

Therefore, conventionally, either light-fastness or color-forming property is sacrificed and a technique for satisfying all of the performances desired has not been obtained.

SUMMARY OF THE INVENTION

Therefore, the object of the present invention is to provide a silver halide color photographic material fine in spectral absorption characteristics of the yellow color-formed dye and improved in its light-fastness without deteriorating the performance, such as the color-forming property.

Other and further objects, features, and advantages of the invention will be appear more fully from the following description.

DETAILED DESCRIPTION OF THE INVENTION

The inventors have studied in various ways and have found that the above object can be attained by a silver halide color photographic material having at least one photosensitive silver halide emulsion layer and at least one non-photosensitive hydrophilic colloid layer on a support, which comprises, in at least one of said photosensitive layers, at least one coupler selected from an acylacetamide yellow dye-forming coupler represented by the following formula (I), and, in at least one of said photosensitive layers or said non-photosensitive layers, at least one compound represented by the following formula (II) or (III):

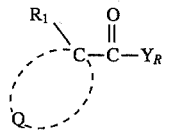

Formula (I)

wherein $R_1$ represents a monovalent group, Q represents a group of non-metallic atoms required to form together with the C (carbon atom) a substituted or unsubstituted 3- to 5-membered cyclic hydrocarbon group or a substituted or unsubstituted 3- to 5-membered heterocyclic group that has in the group at least one heteroatom selected from a group consisting of N, S, O, and P, and $Y_R$ represents a residue remaining after removing the acyl group

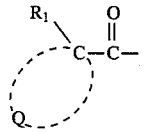

at the α position of the acetamide moiety from the acetylacetamide yellow dye-forming coupler represented by formula (I), provided that $R_1$ is not a hydrogen atom and does not bond to Q to form a ring,

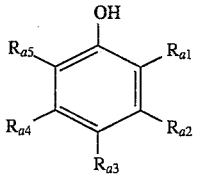

Formula (II)

wherein $R_{a1}$, $R_{a2}$, $R_{a3}$, $R_{a4}$, and $R_{a5}$, which may be the same or different, each represent a hydrogen atom, an alkyl group, an alkenyl group, an aryl group, a heterocyclic group, —A-$R_{a6}$, —N($R_{a6}$)($R_{a6}$'), —$COR_{a6}$", —$SO_2R_{a6}$", a cyano group, a halogen atom, or a nitro group, (wherein —A— represents —O— or —S—, $R_{a6}$ represents a hydrogen atom or a monovalent organic group, $R_{a6}$' and $R_{a6}$" each represent a hydroxyl group or a monovalent organic group), provided that $R_{a1}$, $R_{a2}$, $R_{a3}$, $R_{a4}$, and $R_{a5}$ are not hydrogen atoms at the same time, and that among the substituents $R_{a1}$, $R_{a2}$, $R_{a3}$, $R_{a4}$, and $R_{a5}$, those substituents which are in ortho positions to one another may bond together to form a 5- to 7-membered ring, which may be a spiro ring or a bicyclo ring, Formula (III)

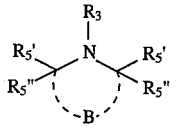

wherein $R_3$ represents a hydrogen atom, —$OR_4$ (wherein $R_4$ represents a hydrogen atom or an alkyl group), an oxy radical, —$SOR_4$', —$SO_2R_4$' (wherein $R_4$' represents an alkyl group or an aryl group), an alkyl group, an alkenyl group, an alkynyl group, or —$COR_4$" (wherein $R_4$" represents a hydrogen atom or a monovalent organic group); $R_5$' and $R_5$", which may be the same or different, each represent an alkyl group; B represents a group of non-metallic atoms required to form together with the nitrogen atom a 5- to 7-membered ring, and $R_5$' and $R_5$" may bond together to form a 5- to 7-membered ring.

In formula (III), $R_5$' and $R_5$" each are two in number, the two groups $R_5$' may be the same or different, and the two groups $R_5$" may be the same or different.

The specific constitution of the present invention will now be described in detail.

The acylacetamide yellow coupler of the present invention is preferably represented by the following formula (Y):

Formula (Y)

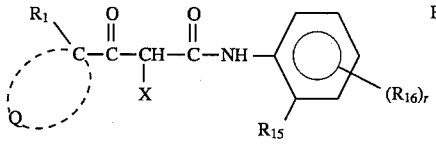

In formula (Y), $R_1$ represents a monovalent group other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, S, O, and P; $R_{15}$ represents a hydrogen atom, a halogen atom (e.g., F, Cl, Br, and I, which is applied hereinafter to the description of formula (Y)), an alkoxy group, an aryloxy group, an alkyl group, or an amino group; $R_{16}$ represents a group capable of substitution onto a benzene ring, X represents a hydrogen atom or a group capable of being released upon a coupling reaction thereof with the oxidized product of an aromatic primary amine developing agent (hereinafter referred to as coupling split-off group), r is an integer of 0 to 4, and when r is 2 or more, the $R_{16}$ groups may be the same or different.

In formula (I), $Y_R$ represents a residue remaining after removing the acyl group

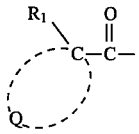

from the acylacetamide yellow dye-forming coupler represented by formula (I), In other words, $Y_R$ represents the remaining portion of formula (I) that does not correspond to the acyl group referred to above. Preferably $Y_R$ represents the following residue as shown in formula (Y)

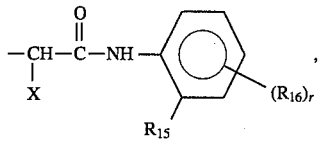

wherein the substituents are as defined in formula (Y). $Y_R$ may also be represented by the corresponding residues as shown in publications.

When any of the substituents in formula (Y) is an alkyl group or contains an alkyl group, unless otherwise specified, the alkyl group means a straight chain, branched-chain, or cyclic alkyl group, which may be substituted and/or unsaturated (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl).

When any of the substituents in formula (Y) is an aryl group or contains an aryl group, unless otherwise specified, the aryl group means a monocyclic or condensed cyclic aryl group, which may be substituted, containing (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl).

When any of the substituents in formula (Y) is a heterocyclic group or contains a heterocyclic group, unless otherwise specified, the heterocyclic group means a 3- to 8-membered monocyclic or condensed ring heterocyclic group that contains at least one heteroatom selected from the group consisting of O, N, S, P, Se, and Te, and contains from 2 to 36 carbon atoms and may be substituted (e.g., 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedion-3-yl).

Substituents preferably used in formula (Y) will now be described below.

In formula (Y), preferably $R_1$ represents a halogen atom, a cyano group, a monovalent aliphatic-type group that may be substituted and has a total number of carbon atoms (hereinafter abbreviated to a total C-number) of 1 to 30 (e.g., alkyl and alkoxy) or a monovalent aryl-type group that may be substituted and has a total C-number of 6 to 30 (e.g., aryl and aryloxy), whose substituent includes, for example, a halogen atom, an alkyl group, an alkoxy group, a nitro group, an amino group, a carbonamido group, a sulfonamido group, and an acyl group.

In formula (Y), Q preferably represents a group of non-metallic atoms required to form together with the C a substituted or unsubstituted 3- to 5-membered hydrocarbon ring having a total C-number of 3 to 30 or a substituted or unsubstituted 3- to 5-membered heterocyclic ring moiety having a total C-number of 2 to 30 and in the group at least one heteroatom selected from a group consisting of N, S, O, and P. The ring formed by Q together with the C may have an unsaturated bond in the ring. Examples of the ring formed by Q together with the C include a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of the substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (Y), $R_{15}$ preferably represents a halogen atom, an alkoxy group that may be substituted and has a total C-number of 1 to 30, an aryloxy group that may be substituted and has a total C-number of 6 to 30, an alkyl group that may be substituted and has a total C-number of 1 to 30, or a amino group that may be substituted and has a total C-number of 0 to 30, and the substituent includes, for example, a halogen atom, an alkyl group, an alkoxy group, and an aryloxy group.

Examples of $R_{16}$ in formula (Y) include a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group (as defined above), a cyano group, an acyl group, an acyloxy group, an alkylsulfonyloxy group, and an arylsulfonyloxy group; and examples of the coupling split-off group include a heterocyclic group (as defined above) bonded to the coupling active site through the nitrogen atom, an aryloxy group, an arylthio group, an acyloxy group, an alkylsulfonyloxY group, an arylsulfonyloxy group, a heterocyclic oxy group (wherein heterocyclic is as defined above), and a halogen atom.

In formula (Y), $R_{16}$ preferably represents a halogen atom, an alkyl group that may be substituted and has a total C-number of 1 to 30, an aryl group that may be substituted and has a total C-number of 6 to 30, an alkoxy group that may be substituted and has a total C-number of 1 to 30, an alkoxycarbonyl group that may be substituted and has a total C-number of 2 to 30, an aryloxycarbonyl group that may be substituted and has a total C-number of 7 to 30, an carbonamido group that may be substituted and has a total C-number of 1 to 30, a sulfonamido group that may be substituted and has a total C-number of 1 to 30, a carbamoyl group that may be substituted and has a total C-number of 1 to 30, a sulfamoyl group that may be substituted and has a total C-number of 0 to 30, an alkylsulfonyl group that may be substituted and has a total C-number of 1 to 30, an arylsulfonyl group that may be substituted and has a total C-number of 6 to 30, a ureido group that may be substituted and has a total C-number of 1 to 30, a sulfamoylamino group that may be substituted and has a total C-number of 0 to 30, an alkoxycarbonylamino group that may be substituted and has a total C-number of 2 to 30, a heterocyclic group that may be substituted and has a total C-number of 1 to 30, an acyl group that may be substituted and has a total C-number of 1 to 30, an alkylsulfonyloxy group that may be substituted and has a total C-number of 1 to 30, or an arylsulfonyloxy group that may be substituted and has a total C-number of 6 to 30; and examples of substituent for these $R_{16}$ moieties include, for example, a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y), r is preferably an integer of 1 or 2, and the position of the substitution of $R_{16}$ is preferably the meta-position or para-position to

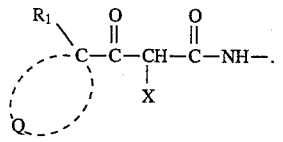

In formula (Y), X preferably represents a heterocyclic group bonded to the coupling active site through the nitrogen atom or an aryloxy group.

When X represents a heterocyclic group, X is preferably a 5- to 7-membered monocyclic group or condensed ring that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine -2-one, benzoxazolidine-2-one, benzothiazoline-2-one, 2-pyrroline-5-one, 2-imidazoline-5-one, indoline-2,3-dione, 2,6-dioxypurine, parabanic acid, 1,2,4-triazolidine- 3,57-dione, 2-pyridone, 4-pyridone, 2-pyrimidone, 6-pyridazone-2-pyrazone, 2-amino-1,3,4-thiazolidine, 2-imino-1,3,4-thiazolidine-4-one, and the like, any of which heterocyclic rings may be substituted. Examples of the substituent on the heterocyclic group include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When X represents an aryloxy group, preferably X represents an aryloxy group having a total C-number of 6 to 30, which may be substituted by a group selected from the group consisting of those substituents mentioned in the case wherein X represents a heterocyclic group. A preferable substituent on the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Now, substituents which are particularly preferably used in formula (Y) will now be described.

$R_1$ is particularly preferably a halogen atom or an alkyl group having a total C-number of 1 to 4, most preferably an ethyl group. Q particularly preferably represents a group of non-metallic atoms which form together with the C a 3- to 5-membered cyclic hydrocarbon group, such as $[C(R)_2]_2$—, —$[C(R)_2]_3$—, and —$[C(R)_2]_4$— wherein R represents a hydrogen atom, a halogen atom, or an alkyl group, the R groups may be the same or different, and $C(R)_2$ groups may be the same or different.

Most preferably Q represents —$[C(R)_2]_2$— which forms a 3-membered ring together with the C bonded thereto.

Particularly preferably $R_{15}$ represents a chlorine atom, a fluorine atom, an alkyl group having a total C-number of 1 to 6 (e.g., methyl, trifluoromethyl, ethyl, isopropyl, and t-butyl), an alkoxy group having a total C-number of 1 to 8 (e.g., methoxy, ethoxy, methoxyethoxy, and butoxy), or an aryloxy group having a total C-number of 6 to 24 (e.g., phenoxy, p-tolyloxy, and p-methoxyphenoxy), most preferably a chlorine atom, a methoxy group, or a trifluoromethyl group.

Particularly preferably $R_3$ represents a halogen atom, an alkoxy group, an alkoxycarbonyl group, an aryloxycarbonyl group, a carbonamido group, a sulfonamido group, a carbamoyl group, or a sulfamoyl group, most preferably an alkoxy group, an alkoxycarbonyl group, a carbonamido group, or a sulfonamido group.

Particularly preferably X is a group represented by the following formula (Y-1), (Y-2), or (Y-3):

Formula (Y-1)

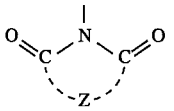

In formula (Y-1), Z represents —O—$CR_{17}(R_{18})$—, —S—$CR_{17}(R_{18})$—, —$NR_{19}$—$CR_{17}(R_{18})$—, —$NR_{19}$—$NR_{20}$—, —$NR_{19}$—C(O)—, $CR_{17}(R_{18})$—$CR_{21}(R_{22})$— or —$CR_{23}$=$CR_{24}$— in which $R_{17}$, $R_{18}$, $R_{21}$, and $R_{22}$ each represent a hydrogen atom, an alkyl group, an aryl group, an alkoxy group, an aryloxy group, an alkylthio group, an arylthio group, an alkylsulfonyl group, an arylsulfonyl group, or an amino group, $R_{19}$ and $R_{20}$ each represent a hydrogen atom, an alkyl group, an aryl group, an alkylsulfonyl group, an arylsulfonyl group, or an alkoxycarbonyl group, $R_{23}$ and $R_{24}$ each represent a hydrogen atom, an alkyl group, or an aryl group, or $R_{23}$ and $R_{24}$ may bond together to form a benzene ring, and $R_{17}$ and $R_{18}$, $R_{18}$ and $R_{19}$, $R_{19}$ and $R_{20}$, or $R_{17}$ and $R_{21}$ may bond together to form a ring (e.g., cyclobutane, cyclohexane, cycloheptane, cyclohexene, pyrrolidine, and piperidine).

Out of the heterocyclic groups represented by formula (Y-1), particularly preferable ones are heterocyclic groups represented by formula (Y-1) wherein Z represents —O—$CR_{17}(R_{18})$—, —$NR_{19}$—$CR_{17}(R_{18})$—, or —$NR_{19}$—$NR_{20}$—. The total C-number of the heterocyclic group represented by formula (Y-1)is 2 to 30, preferably 4 to 20, and more preferably 5 to 16.

Formula (Y-2)

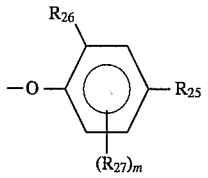

In formula (Y-2), at least one of $R_{25}$ and $R_{26}$ represents a group selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, and an acyl group and the other may be a hydrogen atom, an alkyl group, or an alkoxy group, $R_{27}$ have the same meaning as that of $R_{25}$ or $R_{26}$, and m is an integer of 0 to 2. The total C-number of the aryloxy group represented by formula (Y-2)is 6 to 30, preferably 6 to 24, and more preferably 6 to 15.

Formula (Y-3)

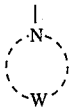

In formula (Y-3), W represents a group of a non-metallic atoms required to form together with the N a pyrrole ring, a pyrazole ring, an imidazole ring, or a triazole ring. Herein, the ring represented by formula (Y-3) may be substituted and a preferable example of the substituent is a halogen atom, a nitro group, a cyano group, an alkoxycarbonyl group, an alkyl group, an aryl group, an amino group, an alkoxy group, an aryloxy group, or a carbamoyl group. The total C-number of the heterocyclic group represented by formula (Y-3) is 2 to 30, preferably 2 to 24, and more preferably 2 to 16.

Most preferably X is a group represented by formula (Y-1).

The coupler represented by formula (Y) may form a dimer or higher polymer formed by bonding through a divalent group or higher polyvalent group at the substituent $R_1$, Q, X, or

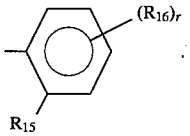

In this case, the total C-number may exceed the range of the total C-number specified in each of the above substituents.

Specific examples of each of the substituents in formula (Y) are shown below.

(1) Examples of the

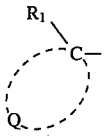

group formed by $R_1$ and Q with C are show below.

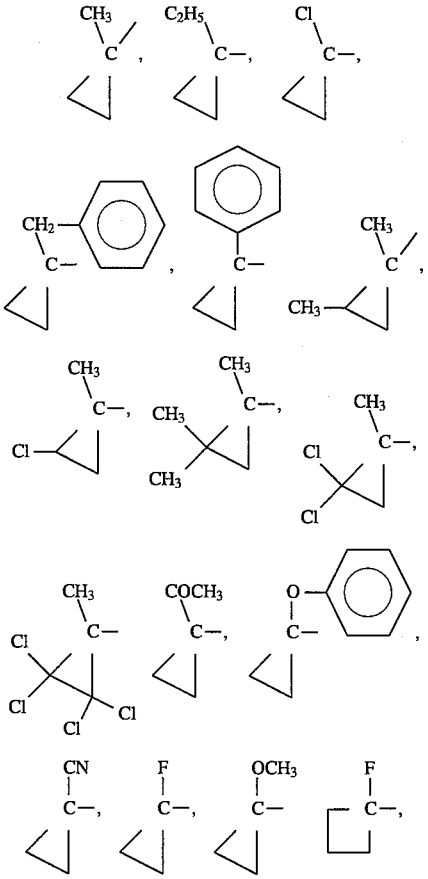

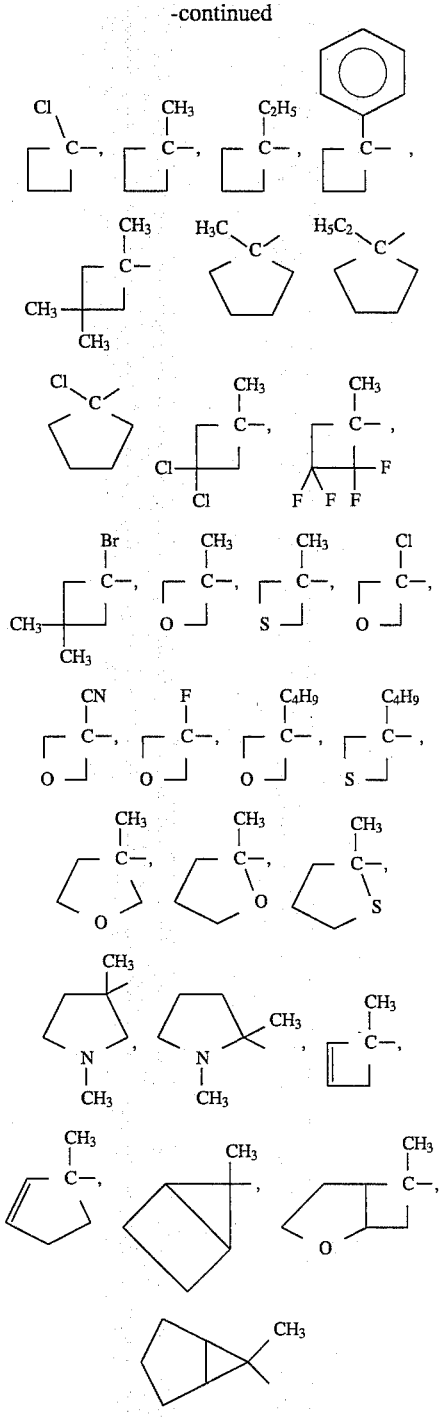

F, Cl, Br, I, $CH_3O$—, 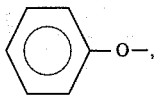 —O—, $CH_3O$— 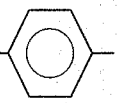 —O—, $CH_3$—, $C_2H_5$—, i-$C_3H_7$—, t-$C_4H_9$—, $CH_3OCH_2CH_2O$—, $CF_3$—, $(CH_3)_2N$—,

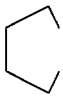

N— n-$C_4H_9O$—, n-$C_{14}H_{29}O$—, n-$C_{16}H_{33}O$—,

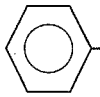

$CH_2O$—, n-$C_{12}H_{25}O$—

(3)Examples of $R_{16}$

F, Cl, Br, I, $CH_3O$—, $C_2H_5O$—, n-$C_{12}H_{25}O$—, $CH_3$, t-$C_4H_9$—, —$COOCH_3$, $COOC_2H_5$,

—$COOC_4H_9$-$^n$, —$COOC_{12}H_{25}$-$^n$, —$OCH_2CH(C_6H_{13}$-$^n)C_8H_{17}$-$^n$

—$COOCH(CH_3)COOC_{12}H_{25}$-$^n$, —$COOCH(C_4H_9$-$^n)COOC_{12}H_{29}$-$^n$,

—COO 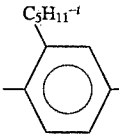 —$C_5H_{11}$-$^t$,

—$CONH(CH_2)_3O$ 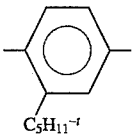 —$C_5H_{11}$-$^t$

—$SO_2NH(CH_2)_4O$ 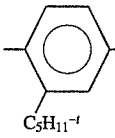 —$C_5H_{11}$-$^t$,

—$SO_2N(CH_3)_2$, —$SO_2NHCOC_2H_5$, —$SO_2NHC_{16}H_{33}$-$^n$,

—$NHCOC_{13}H_{27}$-$^n$, —$NHCOC_{15}H_{31}$-$^n$,

—$NHCOC_{17}H_{35}$-$^n$ —$NHCOCH(C_6H_{13}$-$^n)C_8H_{17}$-$^n$,

—$NHCOCH(CH_2CH_2CH(CH_3)CH_2C_4H_9$-$^t)CH(CH_3)CH_2C_4H_9$-$^t$

—$NHCOCH(CH_3)CH_2SO_2C_{16}H_{33}$-$^n$

—$NHCO(CH_2)_3O$ 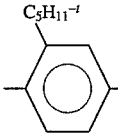 —$C_5H_{11}$-$^t$,

—$NHCOCH(C_2H_5)O$ 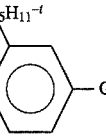 —$C_5H_{11}$-$^t$,

-continued
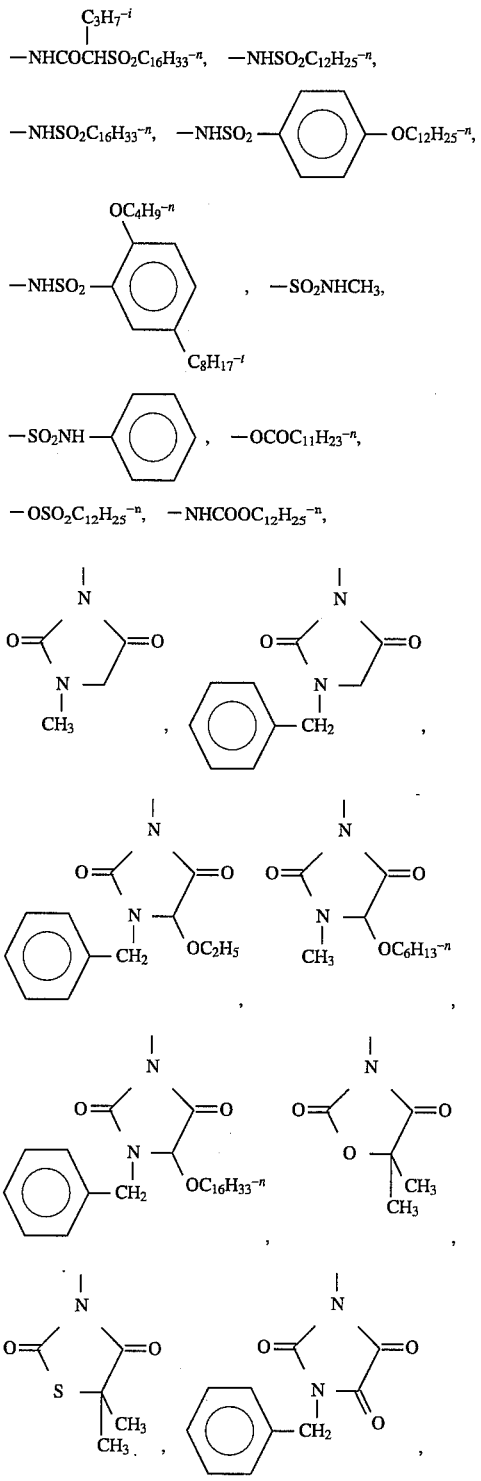
-continued
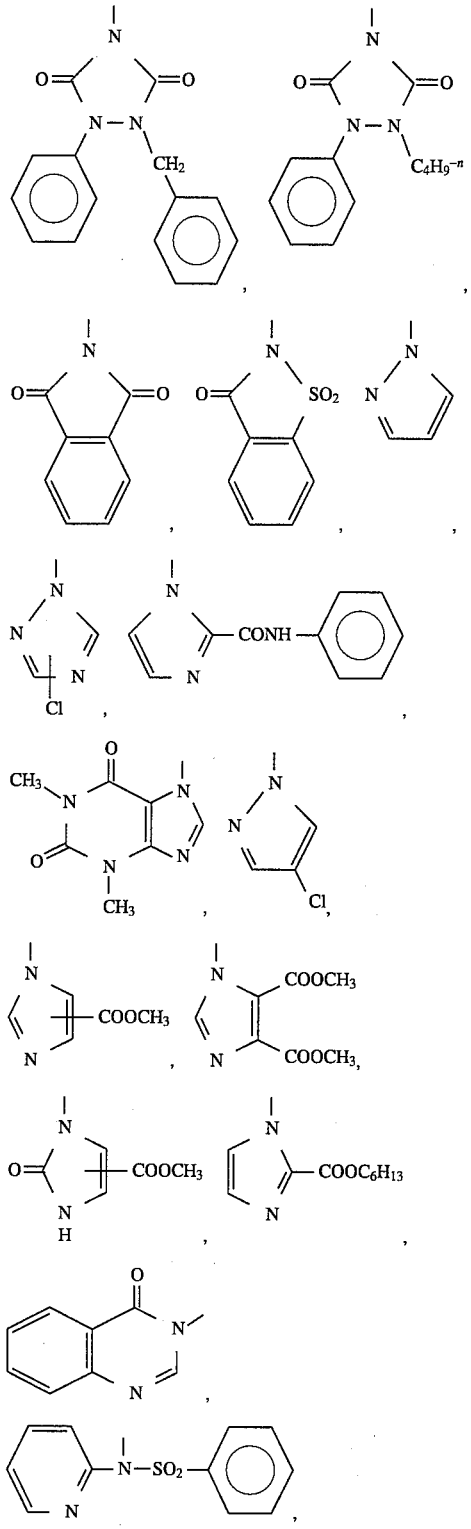

-continued
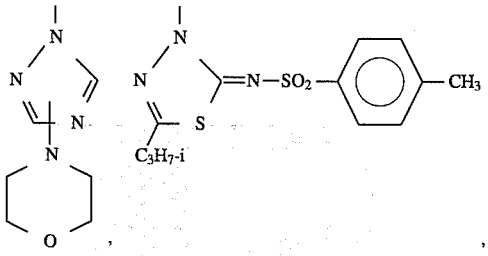
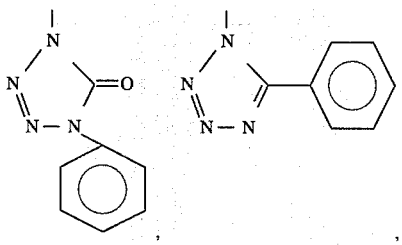
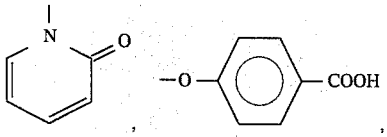
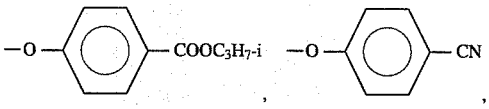
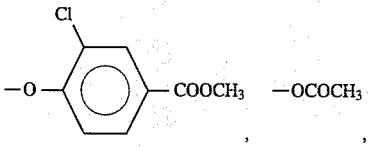
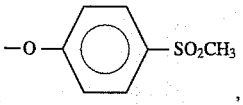
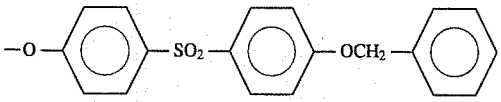
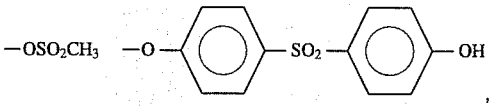
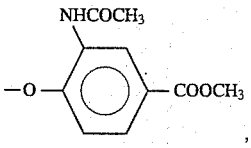
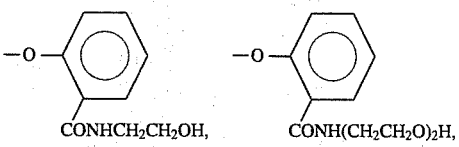
-continued
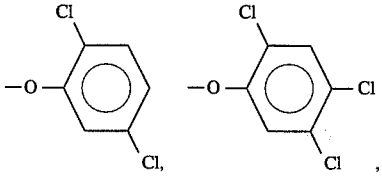
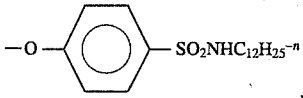
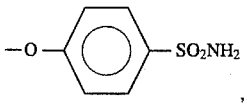
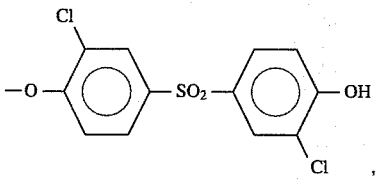
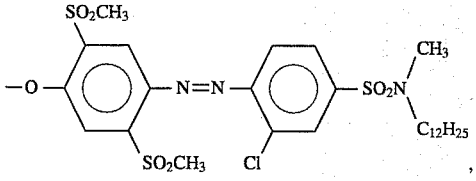
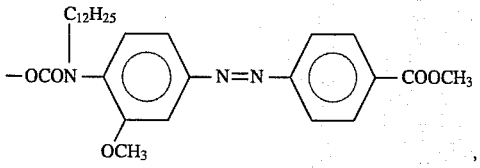
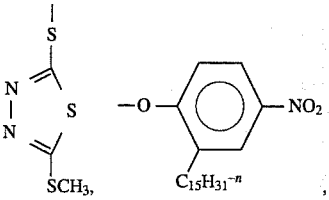
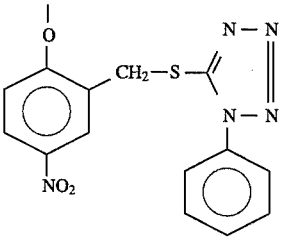
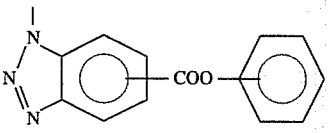

-continued
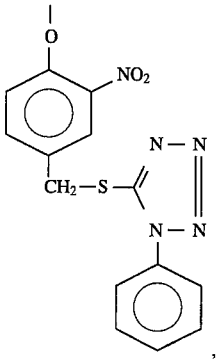
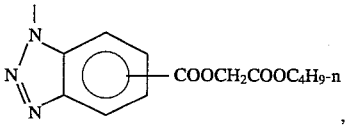
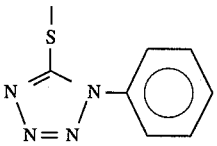
-continued
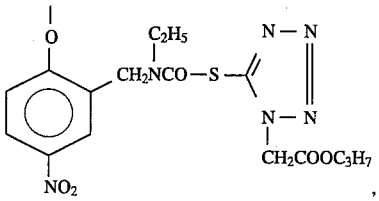
Exemplified yellow couplers represented by (Y) are shown below.
Y-1
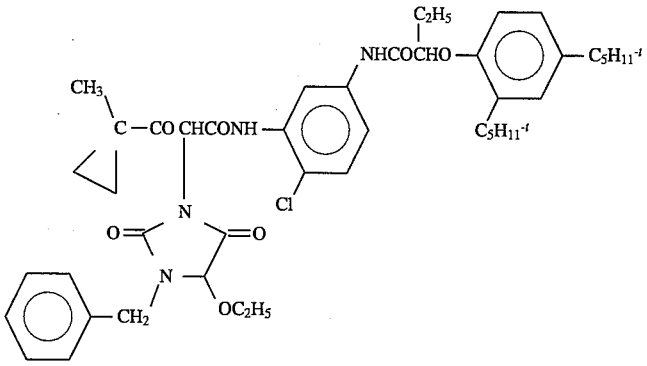
Y-2
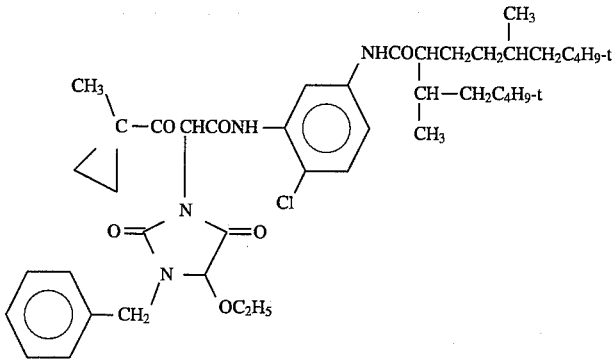

-continued
Y-3
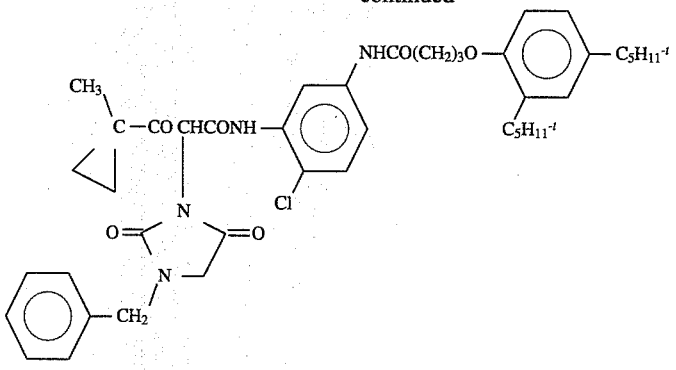
Y-4
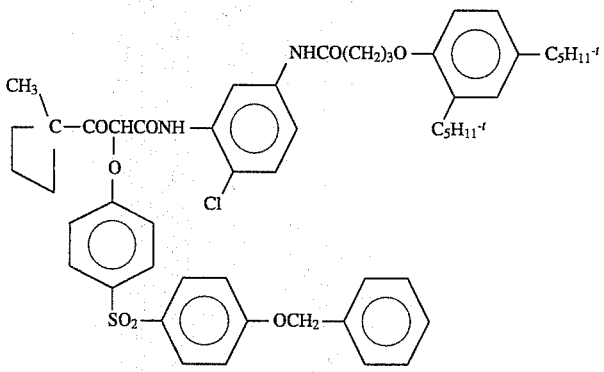
Y-5
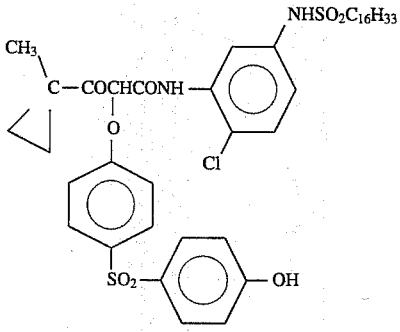
Y-6
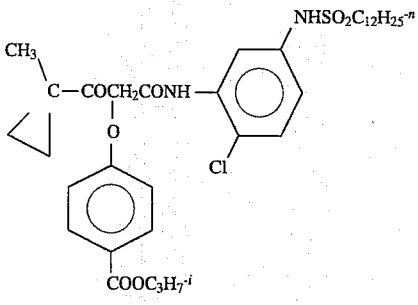
Y-7
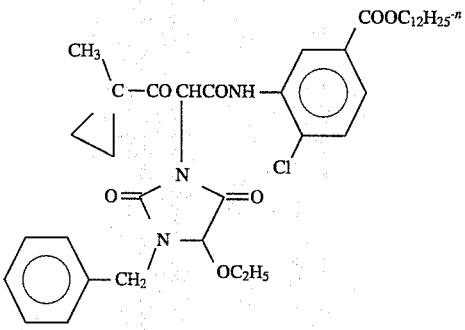

-continued
Y-8
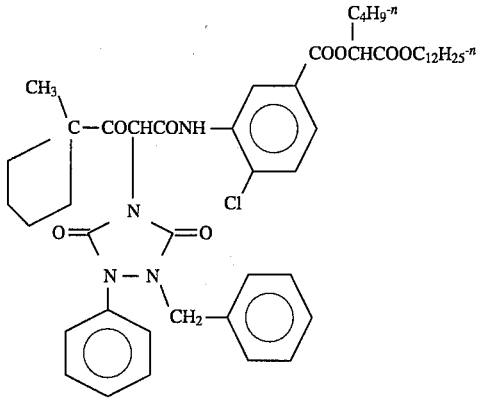
Y-9
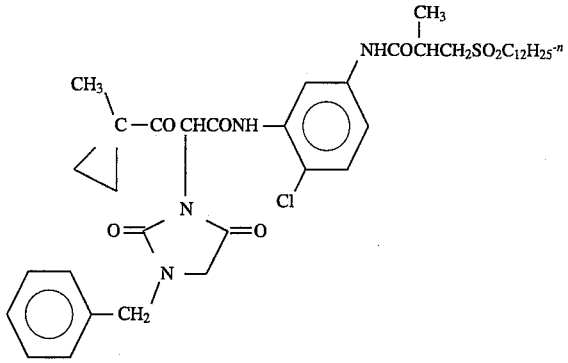
Y-10
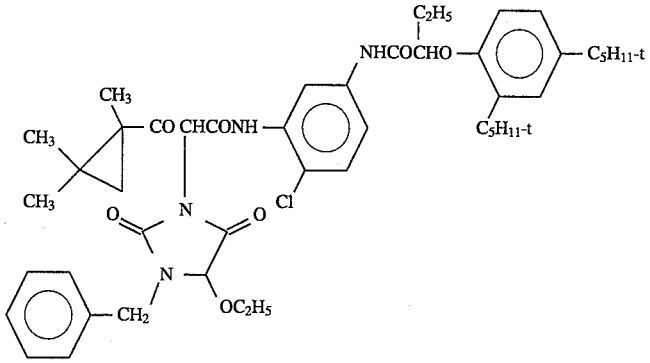
Y-11
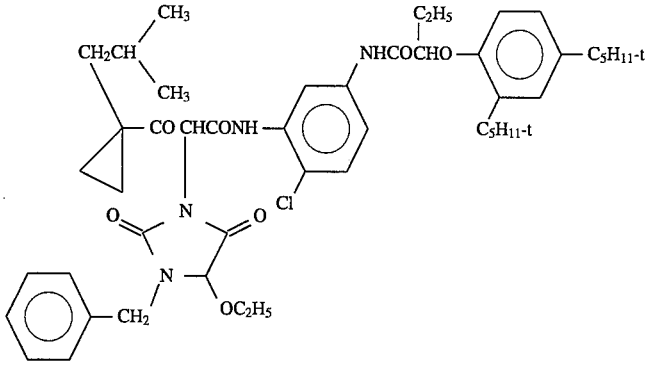

-continued
Y-12
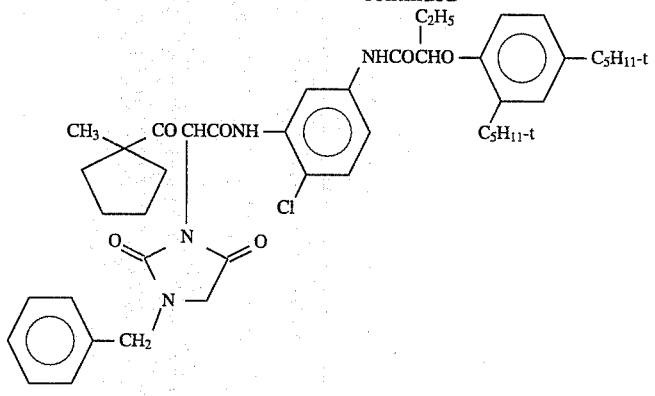
Y-13
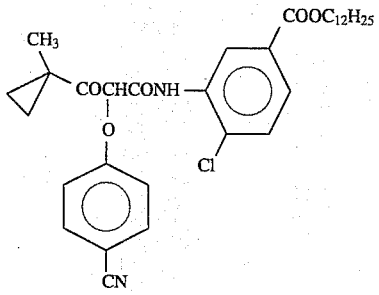
Y-14
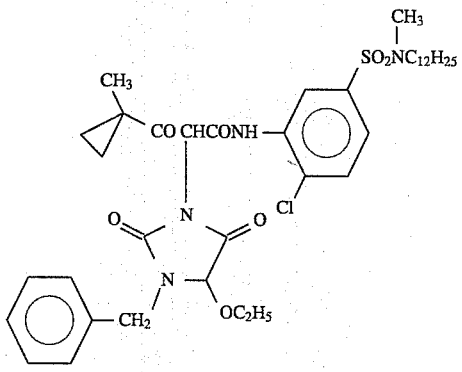
Y-15
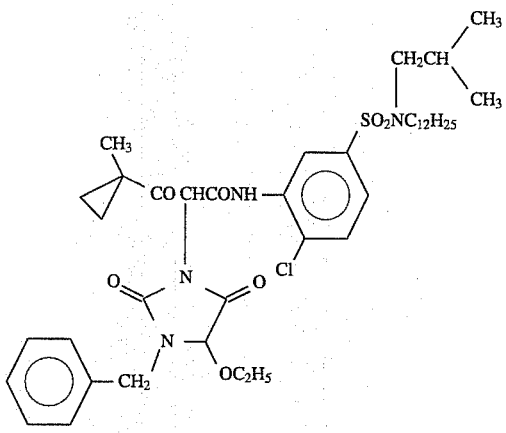

-continued
Y-16
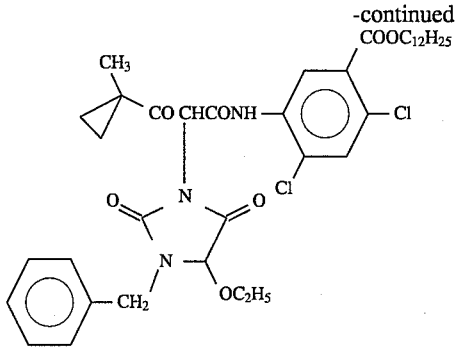
Y-17
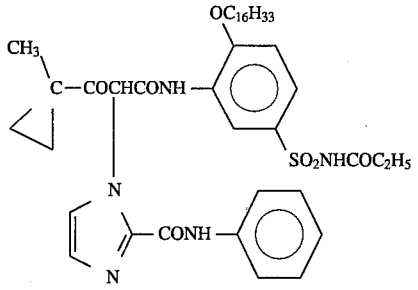
Y-18
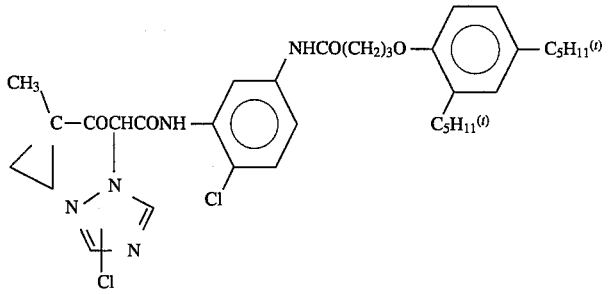
Y-19
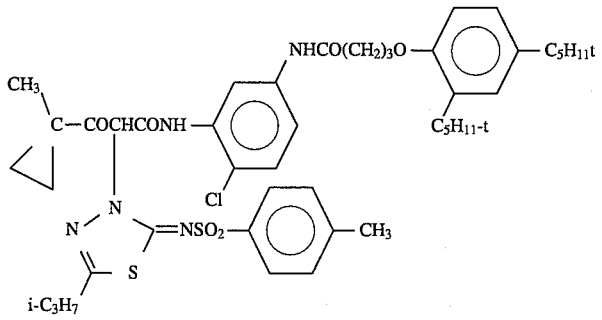
Y-20
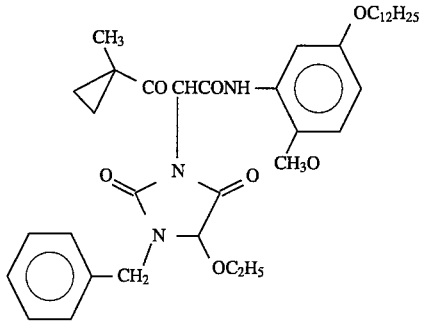

-continued
Y-21
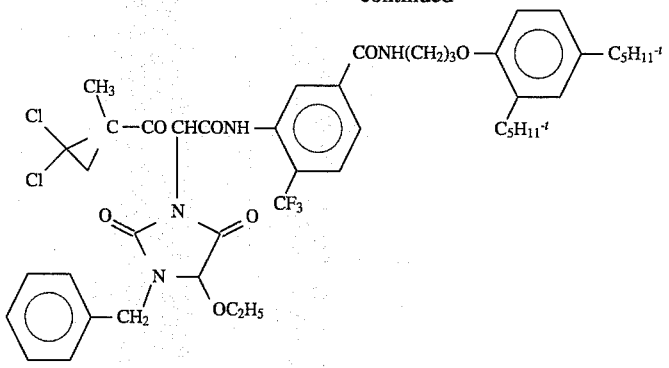
Y-22
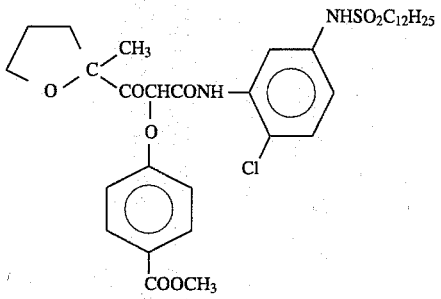
Y-23
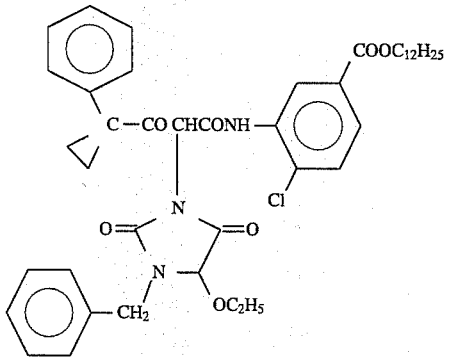
Y-24
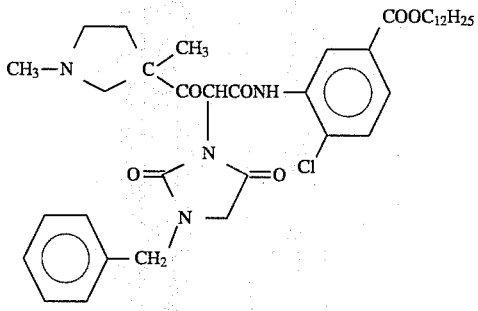
Y-25
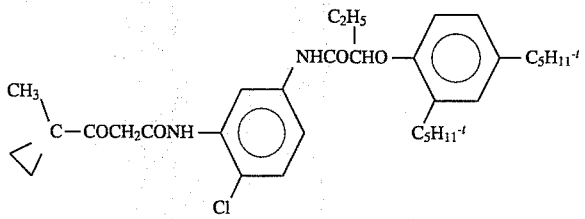
Y-26
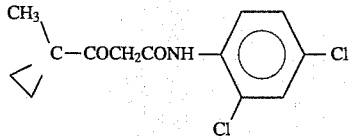

-continued
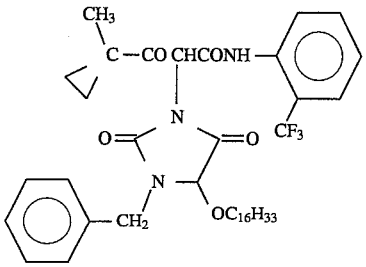
Y-27
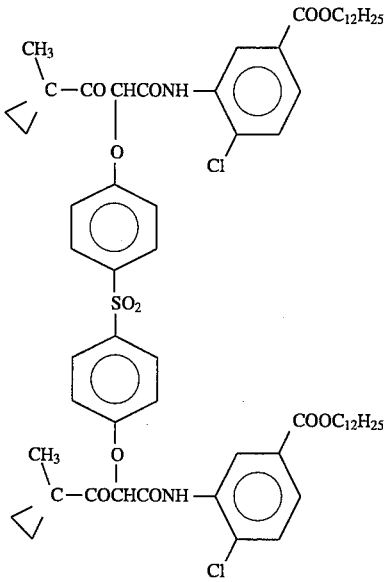
Y-28
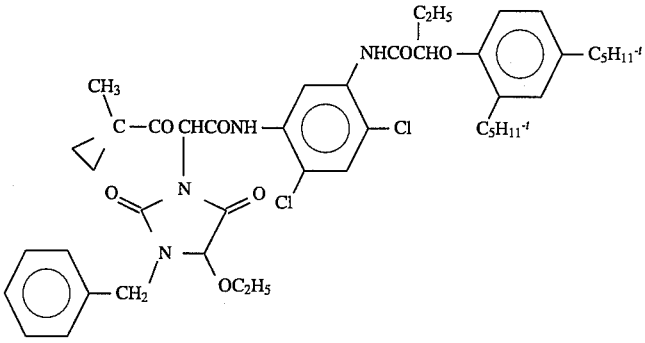
Y-29
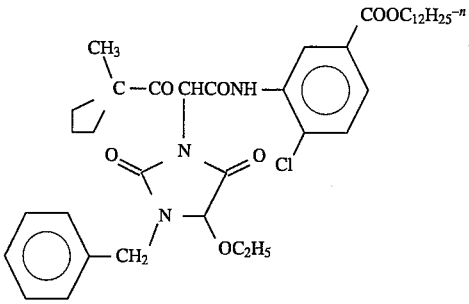
Y-30

-continued
Y-31
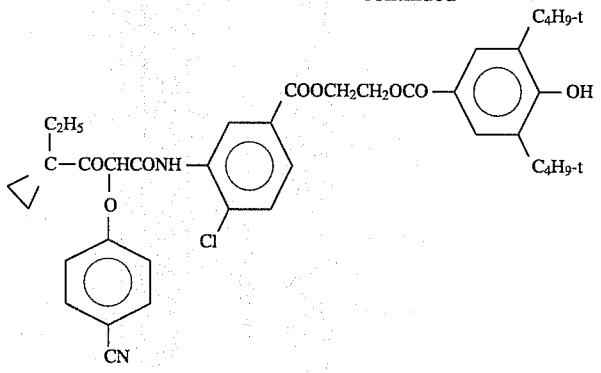
Y-32
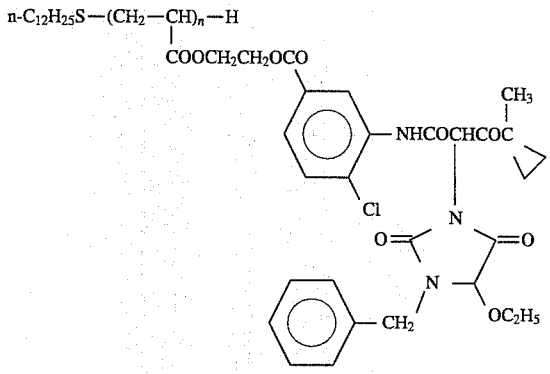
n = 3 (Average)
Y-33
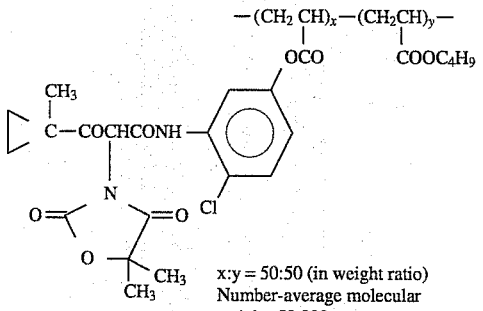
x:y = 50:50 (in weight ratio)
Number-average molecular weight: 50,000
Y-34
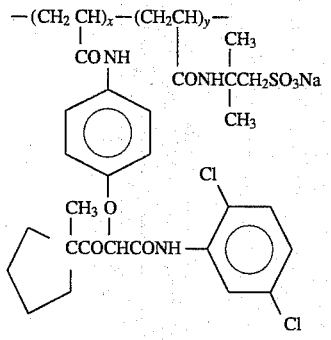
x:y = 80:20 (in weight ratio)
Number-average molecular weight: 70,000

-continued
Y-35
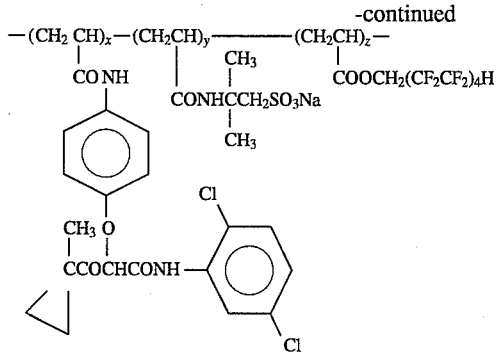
x:y:z = 50:30:20 (in weight ratio)
Number-average molecular
weight: 70,000
Y-36
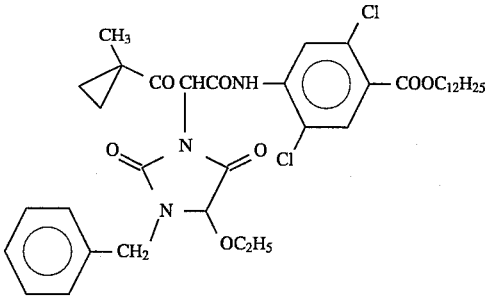
Y-37
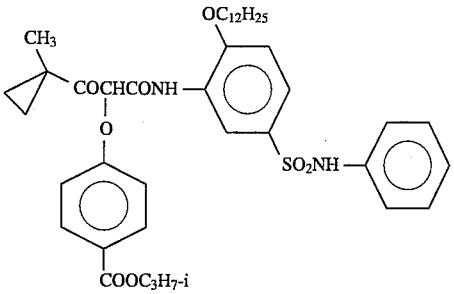
Y-38
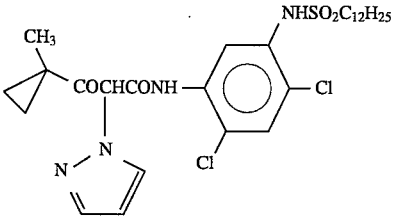
Y-39
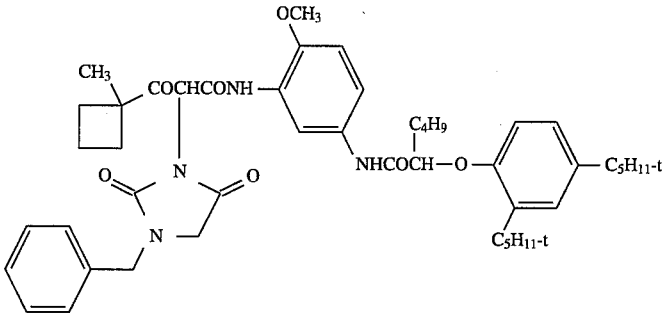

-continued
Y-40
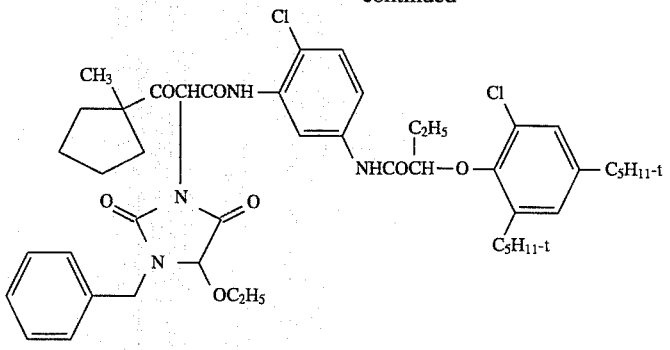
Y-41
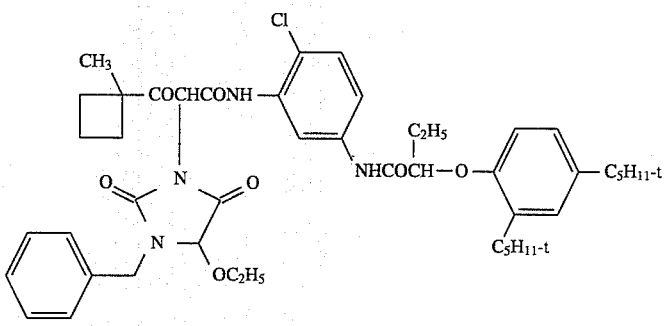
Y-42
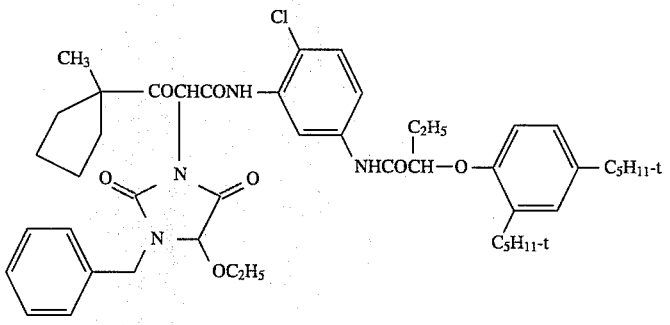
Y-43
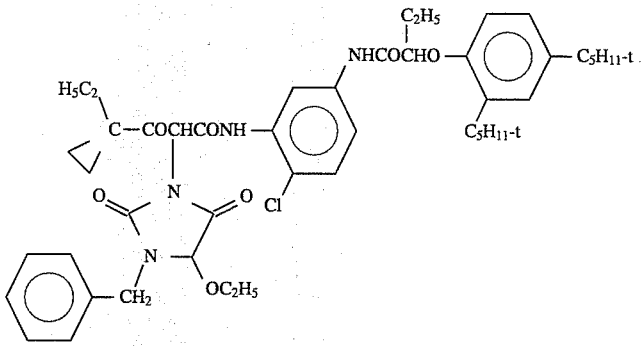
Y-44
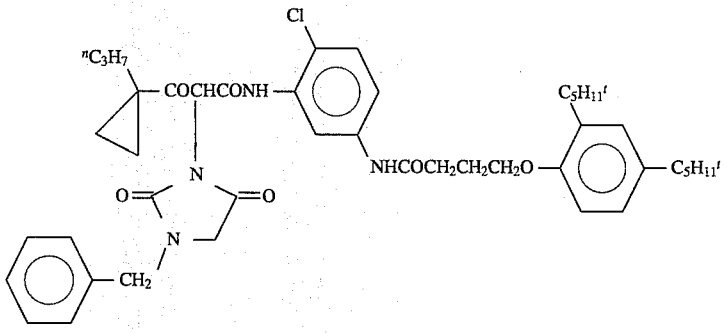

-continued
Y-45
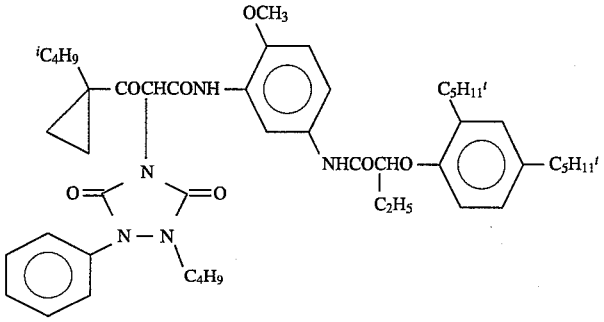
Y-46
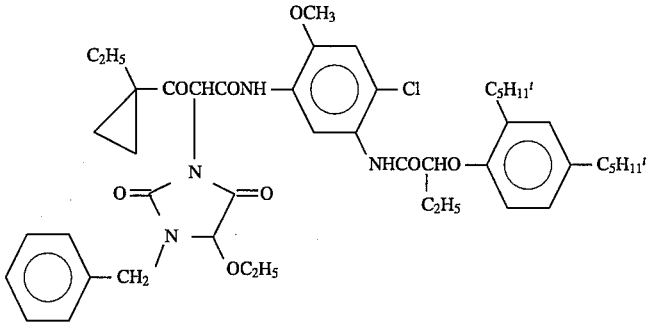
Y-47
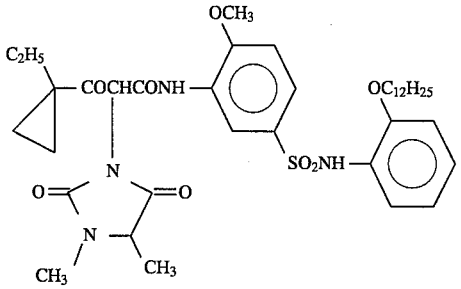
Y-48
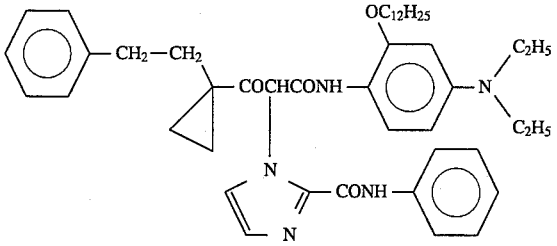
Y-49
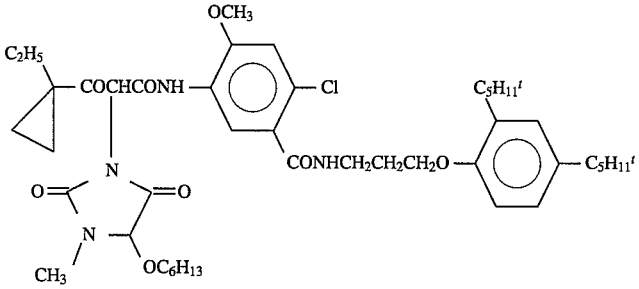

-continued
Y-50
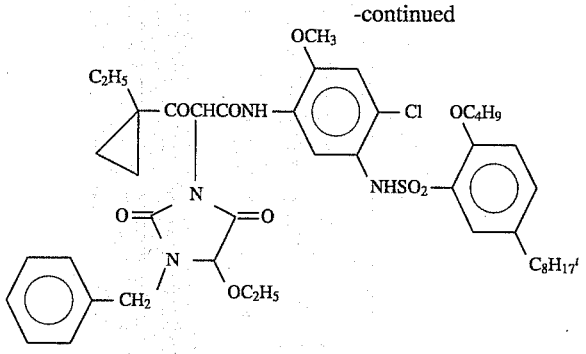
Y-51
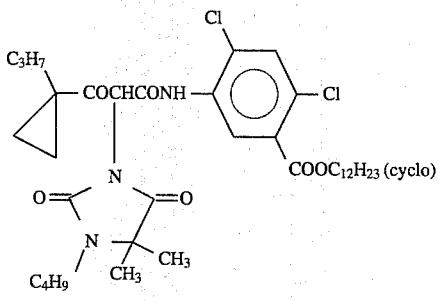
Y-52
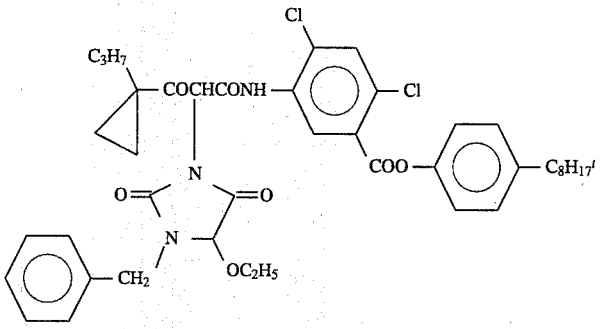
Y-53
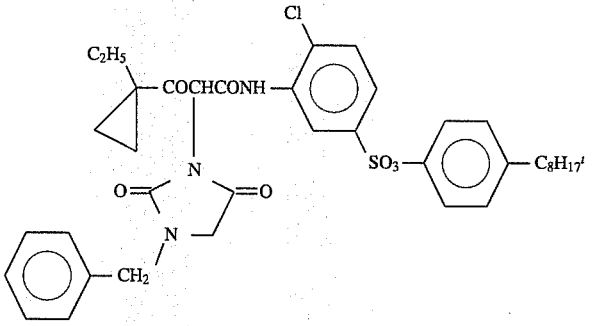
Y-54
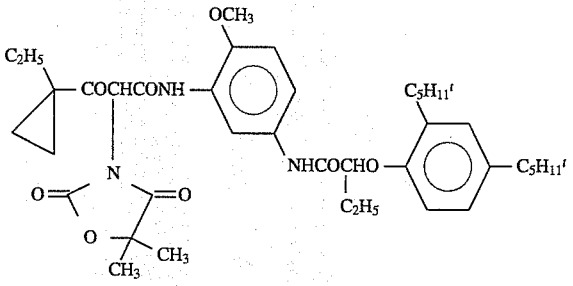

-continued
Y-55
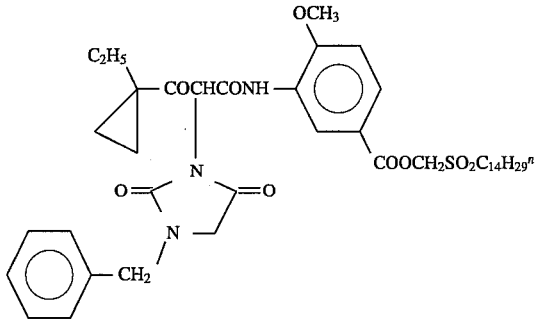
Y-56
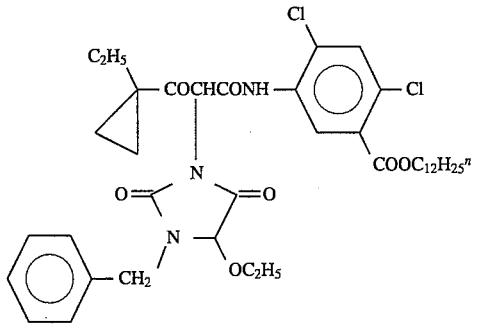
Y-57
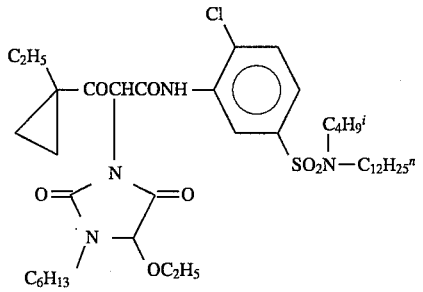
Y-58
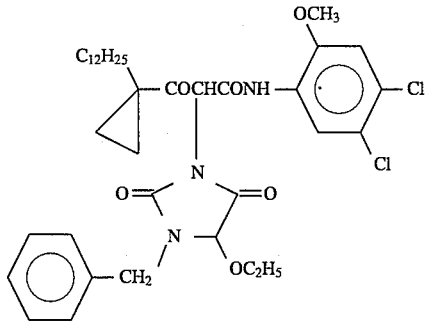
Y-59
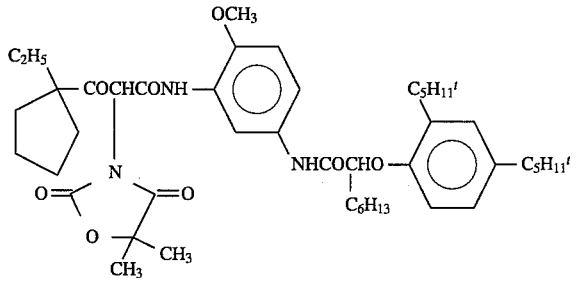

-continued

Y-60

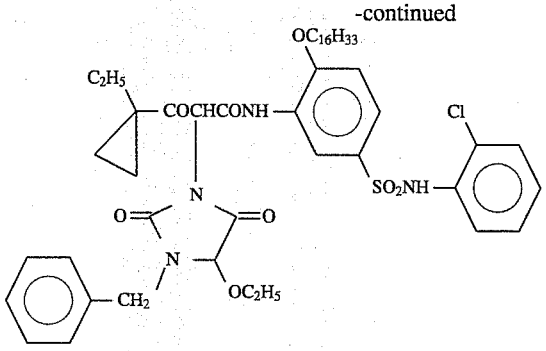

The yellow coupler represented by formula (Y) of the present invention can be synthesized by the following synthesis route:

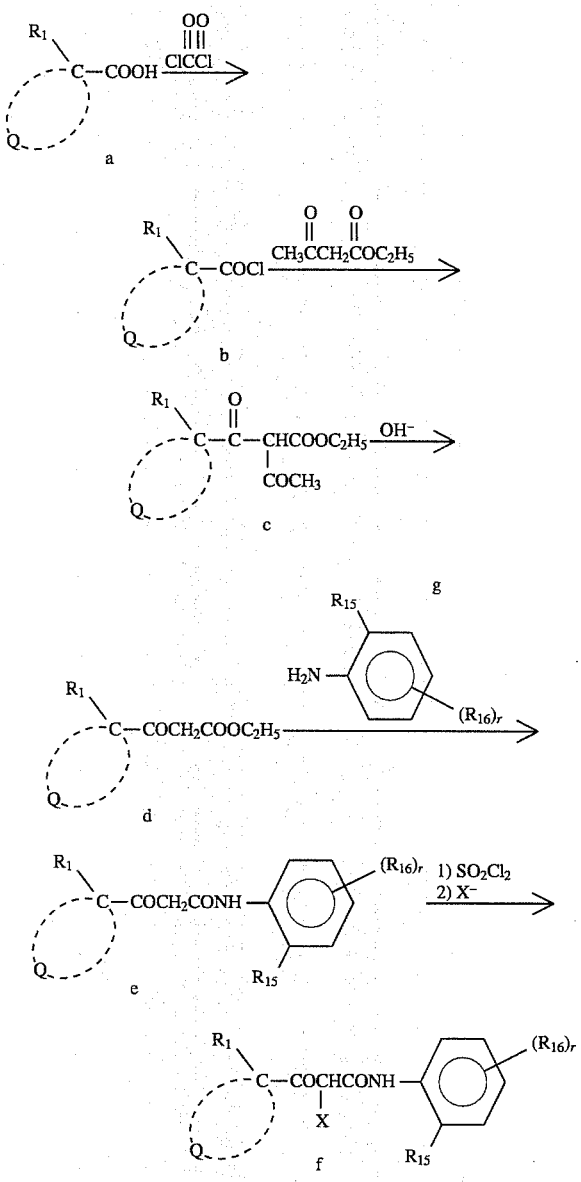

Compound a can be synthesized by a process described, for example, in J. Chem. Soc. (C), 1968, 2548, J. Am. Chem. Soc., 1934, 56., 2710, Synthesis, 1971, 285, J. Org. Chem., 1978, 43, 1729, or CA, 1960, 66, 18533y.

The synthesis of Compound b is carried out by a reaction using thionyl chloride, oxalyl chloride, etc., without a solvent or in a solvent such as methylene chloride, chloroform, carbon tetrachloride, dichloroethane, toluene, N,N-dimethylformamide, or N,N-dimethylacetamide. The reaction temperature is generally about −20° to about 150° C., preferably about −10° to about 80° C.

Compound c is synthesized by converting ethyl acetoacetate into an anion using magnesium methoxide or the like and adding b thereinto. The reaction is carried out without a solvent or in tetrahydrofuran, ethyl ether, or the like, and the reaction temperature is generally about −20° to about 60° C., preferably about −10° to about 30° C. Compound d is synthesized by a reaction using Compound c and, as a base, aqueous ammonia, an aqueous $NaHCO_3$ solution, an aqueous sodium hydroxide solution, or the like, without a solvent or in a solvent such as methanol, ethanol, and acetonitrile. The reaction temperature is about −20° to about 50° C., preferably about −10° to about 30° C.

Compound e is synthesized by reacting Compounds d and g without a solvent. The reaction temperature is generally about 100° to about 150° C., preferably about 100° to about 120° C. When X is not H, after chlorination or bromination the split-off group X is introduced to synthesize Compound f. Compound e is converted, in a solvent such as dichloroethane, carbon tetrachloride, chloroform, methylene chloride, or tetrahydrofuran, to the chlorine-substituted product by using sulfuryl chloride, N-chlorosuccinimide, or the like, or to the bromine-substituted product by using bromine, N-bromosuccinimide, or the like. At that time the reaction temperature is about −20° to about 70° C., preferably about −10° to about 50° C.

Then the chlorine-substituted product or the bromine-substituted product and the proton adduct H-X of the split-off group are reacted in a solvent, such as methylene chloride, chloroform, tetrahydrofuran, acetone, acetonitrile, dioxane, N-methylpyrrolidone, N,N'-dimethylimidazolidine- 2-one, N,N-dimethylformamide, or N,N-dimethylacetamide at a reaction temperature of about −20° to about 150° C., preferably about −10° to about 100° C., so that Coupler f of the present invention can be obtained. At that time a base can be used, such as triethylamine, N-ethylmorpholine, tetramethylguanidine, potassium carbonate, sodium hydroxide, or sodium bicarbonate.

Synthesis Examples of couplers of the present invention are shown below.

Synthesis Example 1

Synthesis of Exemplified Compound Y-25

38.1 g of oxalyl chloride was added dropwise over 30 min to a mixture 25 g of 1-methylcyclopropanecarboxylic acid, which was synthesized by the method described by Gotkis, D., et al., J. Am. Chem. Sock, 1934, 56, 2710, 100 ml of methylene chloride, and 1 ml of N,N-dimethylformamide. After the addition the reaction was carried out for 2 hours at room temperature, and then the methylene chloride and excess oxalyl chloride were removed under reduced pressure by an aspirator, thereby producing an oil of 1-methylcyclopropanecarbonyl chloride.

100 ml of methanol was added dropwise over 30 min at room temperature to a mixture of 6 g of magnesium and 2 ml of carbon tetrachloride, after which the mixture was heated for 2 hours under reflux, and then 32.6 g of ethyl 3-oxobutanate was added dropwise over 30 min under heating and reflux. After the addition the mixture was heated under reflux for 2 hours, and then the methanol was distilled off completely under reduced pressure by an aspirator. 100 ml of tetrahydrofuran was added to and dispersed in the resultant solution, and the previously prepared 1-methylcyclopropanecarbonyl chloride was added dropwise to the dispersion at room temperature. After reacting for 30 min, the reaction liquid was subjected to extraction with 300 ml of ethyl acetate and diluted sulfuric acid, the organic layer was washed with water and dried over anhydrous sodium sulfate, and then the solvent was distilled off, to produce 55.3 g of an oil of ethyl 2-(1-methylcyclopropanecarbonyl)-3-oxobutanate.

A solution of 55 g of the ethyl 2-(1-methylcyclopropanecarbonyl)- 3-oxobutanate and 160 ml of ethanol was stirred at room temperature, and 60 ml of a 30% aqueous ammonia was added thereto over 10 min. Thereafter the resulting mixture was stirred for 1 hour and then was subjected to extraction with 300 ml of ethyl acetate and diluted hydrochloric acid, followed by neutralizing and washing with water; then the organic layer was dried over anhydrous sodium sulfate and the solvent was distilled off, to produce 43 g of an oil of ethyl (1-methylcyclopropanecarbonyl)acetate.

34 g of the ethyl (1-methylcyclopropanecarbonyl)-acetate and 44.5 g of N-(3-amino-4-chlorophenyl)-2-( 2,4-di-t-pentylphenoxy)butaneamide were heated at an internal temperature of 100° to 120° C. under reflux and reduced pressure by an aspirator. After reacting for 4 hours, the reaction solution was purified by column chromatography with a mixed solvent of n-hexane and ethyl acetate, to produce a viscous oil of 49 g of the Exemplified Compound Y-25. The structure of the compound was identified by MS spectrum, NMR spectrum, and elemental analysis.

Synthesis Example 2

Synthesis of Exemplified Compound Y-1

22.8 of the Exemplified Compound Y-25 was dissolved in 300 ml of methylene chloride, and 5.4 g of sulfuryl chloride was added dropwise over 10 min to the resulting solution under cooling with ice. After reacting for 30 min, the reaction liquid was washed well with water and was dried over anhydrous sodium sulfate, followed by concentration, to obtain the chloride of the Exemplified Compound Y-25. A solution of the thus synthesized chloride of the Exemplified Compound Y-25 in 50 ml of N,N-dimethylformaldehyde was added dropwise over 30 min at room temperature to a solution of 18.7 g of 1-benzyl-5-ethoxyhydantoin, 11.2 ml of triethylamine, and 50 ml of N,N-dimethylformamide.

Thereafter the reaction was allowed to continue for four hours at 40° C., and then the reaction liquid was subjected to extraction with 300 ml of ethyl acetate, thereafter washed with water and then washed with 300 ml of a 2% aqueous triethylamine solution. This was followed by neutralization with diluted hydrochloric acid. After the organic layer was dried over anhydrous sodium sulfate, the solvent was distilled off, and the thus obtained oil was crystallized from a mixed solvent of n-hexane and ethyl acetate. After the thus obtained crystals were filtered off, followed by washing with a mixed solvent of n-hexane and ethyl acetate, they were dried, to obtain 22.8 g of crystals of the Exemplified Compound Y-1. The structure of the compound was identified by MS spectrum, NMR spectrum, and elemental analysis. The melting point was 132° to 133° C.

The acylacetamide yellow couplers represented by formula (I) may be used as a mixture of two or more thereof and also may be used in combination with yellow couplers which fall outside the present invention.

The yellow coupler of the present invention is used in an amount generally in the range 0.1 to 1.0 mol, more preferably in the range of 0.1 to 0.5 mol, per mol of the silver halide in the silver halide emulsion layer that forms a photosensitive layer.

The compound represented by formula (II) will now be described.

The alkyl group and the alkenyl group represented by $R_{a1}$ to $R_{a5}$ may be straight-chain, branched chain, or cyclic and may be substituted and examples of the substituent include a halogen atom, a hydroxyl group, a nitro group, a cyano group, an aryl group, an amino group, an alkoxycarbonyl group, an aryloxycarbonyl group, a carbamoyl group, a sulfamoyl group, a heterocyclic group, an alkoxy group, an aryloxy group, an alkylthio group, an arylthio group, an acylamino group, a sulfonamido group, an acyl group, an acyloxy group, an alkylsulfonyl group, an arylsulfonyl group, a heterocyclic oxy group, an alkylamino group, an arylamino group, a ureido group, and a urethane group. The alkyl group includes, for example, a methyl group, an ethyl group, a n-butyl group, a t-butyl group, a cyclohexyl group, an octyl group, an octadecyl group, a methoxyethyl group, and a benzyl group. The alkenyl group includes, for example, an ally group, a vinyl group, a cyclohexenyl group, and a 1-octadecenyl group.

The aryl group and the heterocyclic group represented by $R_{a1}$ to $R_{a5}$ may be substituted and the substituent may be any one capable of substitution. Examples of the substituent include an alkyl group, a hydroxyl group, an acylamino group, an alkylamino group, an arylamino group, an amino group, a carbamoyl group, a sulfamoyl group, an alkoxy group, an aryloxy group, an alkylthio group, an arylthio group, a halogen atom, a cyano group, a nitro group, an alkoxycarbonyl group, an aryloxycarbonyl group, an acyl group, an acyloxy group, an alkylsulfonyl group, an arylsulfonyl group, a heterocyclic oxy group, a ureido group, a urethane group, and a sulfonamido group. The aryl group includes, for example, a phenyl group, a 2-hydroxylphenyl group, a 4-hydroxyphenyl group, a 2-benzyloxyphenyl group, a 2-hydroxy- 3,5-dimethylphenyl group, and a naphthyl group. The heterocyclic group includes, for example, a 2-pyridyl group, a 4-morpholyl group, and a 1-indolinyl group.

The monovalent organic group represented by $R_{a6}$, $R_{a6}'$, and $R_{a6}''$ may be any one capable of substitution such as an alkyl group, an aryl group, an alkoxy group, an aryloxy group, a substituted amino group, an acyl group, a sulfonyl group, a hydroxyl group, and a heterocyclic group. More particularly, as —A—$R_{a6}$, for example, an alkoxy group, an aryloxy group, an alkylthio group, an arylthio group, and a heterocyclic oxy group can be mentioned and as —N($R_{a6}$)($R_{a6}$'), for example, an alkylamino group, an acylamino group, and a sulfonamido group can be mentioned. As —COR$_{a6}$", for example, a carbamoyl group, an acyl group, an alkoxycarbonyl group, an aryloxycarbonyl group, and a carboxyl group can be mentioned and as —$SO_2R_{a6}$", for example, an alkylsulfonyl group, an arylsulfonyl group, and a sulfamoyl group can be mentioned.

Out of the substituents $R_{a1}$ to $R_{a5}$, those substituents that are in ortho-positions to one another may bond together to form a 5- to 7-membered ring, such as a chroman ring, a coumaran ring, and an indane ring, which may form a spiro ring or a bicyclo ring.

In the present invention, out of the compounds represented by formula (II), preferable compounds are the following:

1) compounds wherein at least one of $R_{a1}$ and $R_{a5}$ is an alkyl group and more preferably the α-position of the alkyl group is branched;

2) compounds wherein at least one of $R_{a1}$ to $R_{a5}$ is a substituted or unsubstituted benzyl group, aryl group, arylsulfonyl group, arylthio group, or aryloxy group;

3) compounds wherein out of the substituents $R_{a1}$ to $R_{a5}$ these substituents that are in ortho-positions to one another are bonded to form a chroman ring or an indane ring, which compounds may be spiro compounds; and 4) compounds wherein $R_{a1}$ is an acylamino group.

In the present invention, out of the compounds represented by formula (II), more preferable compounds are those represented by the following formulae (IIA) and (IIB):

Formula (IIA)

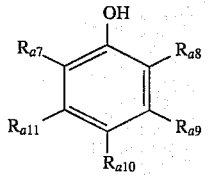

Formula (IIB)

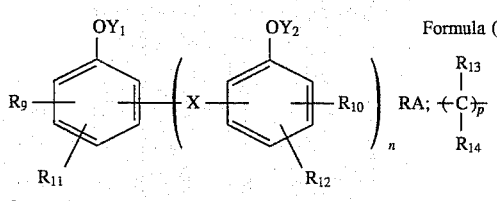

In formula (IIA), $R_{a7}$ and $R_{a8}$ each represent an alkyl group, $R_{a9}$, $R_{a10}$, and $R_{a11}$ each represent an alkyl group, an alkoxy group, an alkoxycarbonyl group, an aryloxycarbonyl group, an alkylamino group, an arylamino group, an acylamino group, or a carbamoyl group, and $R_{a9}$ and $R_{a11}$ each may represent a hydrogen atom. The alkyl group represented by $R_{a7}$ and $R_{a8}$ is preferably an alkyl group preferably an alkyl group having a total C-number of 1 to 12, and more preferably an alkyl group having a total C-number of 3 to 8 and branched at the α-position. Particularly preferably $R_{a7}$ and $R_{a8}$ each represent a t-butyl group or a t-pentyl group. Preferably $R_{a9}$ and $R_{a11}$ each represent a hydrogen atom.

In formula (IIB), $R_9$, $R_{10}$, $R_{11}$, and $R_{12}$ each represent a hydrogen atom or an alkyl group having 1 to 18 carbon atoms, the total of the carbon atoms of $R_9$, $R_{10}$, $R_{11}$, and $R_{12}$ is 32 or less, $Y_1$ and $Y_2$ each represent a hydrogen atom, an alkyl group, an aryl group, a heterocyclic group, an acyl group, a sulfonyl group, or a silyl group, X represents a single bond, an oxygen atom, a sulfur atom, a sulfonyl group, or RA, in which $R_{13}$ and $R_{14}$ each represent a hydrogen atom or an alkyl group having a total C-number of 1 to 10, p is an integer of 1 to 3, n is 1 or 2, when p is 2 or 3, the groups $R_{13}$ or the groups $R_{14}$ may be the same or different, and when n is 2, the groups $R_{10}$, the groups $R_{12}$, or the groups $Y_2$ may be the same or different, provided that at least one of $Y_1$ and $Y_2$ represents a hydrogen atom.

In the present invention, out of the compounds represented by formulae (IIA) and (IIB), more preferable compounds are those represented by the following formulae (IIC) and (IID):

Formula (IIC)

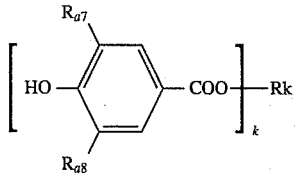

Formula (IID)

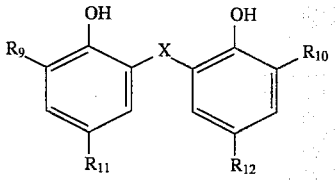

In formula (IIC), $R_{a7}$ and $R_{a8}$ have the same meanings as those defined in formula (IIA), Rk represents a k-valent organic group, and k is an integer of 1 to 6.

The k-valent organic group represented by Rk includes, for example, an alkyl group, an alkenyl group, a polyvalent unsaturated hydrocarbon group (e.g., ethylene, triethylene, propylene, hexamethylene, and 2-chlorotrimethylene), an unsaturated hydrocarbon group (e.g., glycerin, diglycerin, pentaerythrityl, and dipentaerythrityl), an cycloaliphatic hydrocarbon group (e.g., cyclopropyl, cyclohexyl, and cyclohexenyl), an aryl group (e.g., phenyl), an arylene group (e.g., 1,2-, 1,3-, or 1,4-phenylene, 3,5-dimethyl-1,4-phenylene, 2-t-butyl-1,4-phenylene, 2-chloro-1,4-phenylene, and naphthalene), and a 1,3,5-trisubstituted benzene group.

In addition to the above groups, Rk further includes a k-valent organic group formed by bonding any groups of the above groups through a —O—, —S—, or —$SO_2$— group.

More preferably, Rk represents a 2,4-di-t-butylphenyl group, a 2,4-di-t-pentylphenyl group, a p-octylphenyl group, a p-dodecylphenyl group, a 3,5-di-t-butyl-4-hydroxyphenyl group, and a 3,5-di-t-pentyl-4-hydroxyphenyl group.

Preferably k is an integer of 1 to 4.

In formula (IID), $R_9$, $R_{10}$, $R_{11}$, $R_{12}$, and X have the same meanings as those defined in formula (IIB).

In the present invention, compound represented by formula (II) is preferably selected from the group consisting of compounds represented by the following formula (IIE) or (IIF):

Formula (IIE)

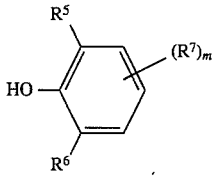

wherein $R^5$ and $R^6$ each represented an alkyl group, $R^7$ represents an alkyl group, —$NHR^8$ (wherein $R^8$ represents a monovalent organic group), or —$COOR^9$ (wherein $R^9$ represents a halogen atom or a monovalent organic group), and m represents an integer of 0 to 3.

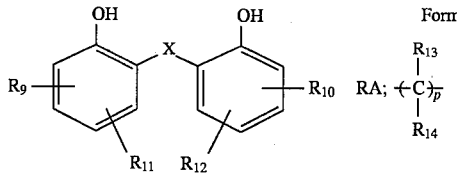

Formula (IIF)

wherein $R_9$, $R_{10}$, $R_{11}$, and $R_{12}$ have the same meanings as those defined in formula (IIB).

Further, compound represented by formula (II) is preferably selected from the group consisting of compounds represented by the above-mentioned formulae (IIE) and the following formula (IIG).

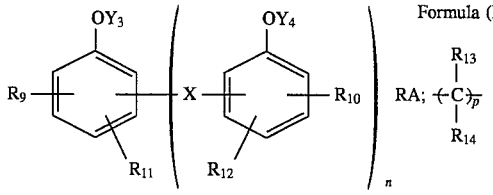

Formula (IIG)

wherein $R_9$, $R_{10}$, $R_{11}$, and $R_{12}$ each represent a hydrogen atom or an alkyl group having 1 to 18 carbon atoms, the total of the carbon atoms of $R_9$, $R_{10}$, $R_{11}$, and $R_{12}$ is 32 or less, $Y_3$ and $Y_4$ each represent a hydrogen atom, an alkyl group, an aryl group, a heterocyclic group, an acyl group, a sulfonyl group, or a silyl group, X represents a single bond, an oxygen atom, a sulfur atom, a sulfonyl group, or RA, in which $R_{13}$ and $R_{14}$ each represent a hydrogen atom or an alkyl group having 1 to 10 carbon atoms, p is an integer of 1 to 3, n is 1 or 2, and when p is 2 or 3, the groups $R_{13}$ or the groups $R_{14}$ may be the same or different.

Specific compounds represented by formula (II) are shown below, but the present invention is not limited to them.

II-1

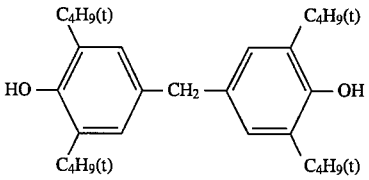

II-2

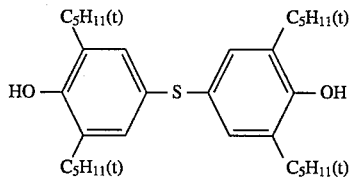

II-3

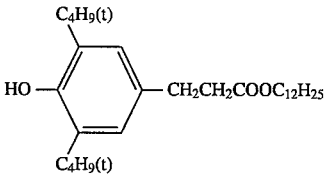

II-4

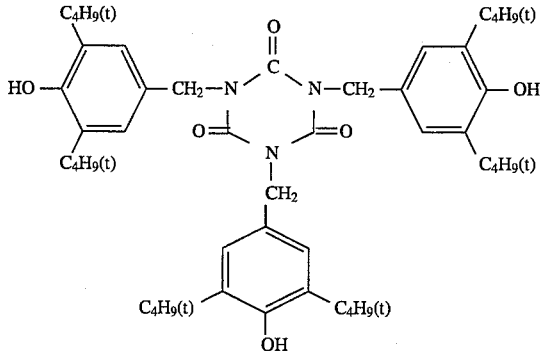

II-5

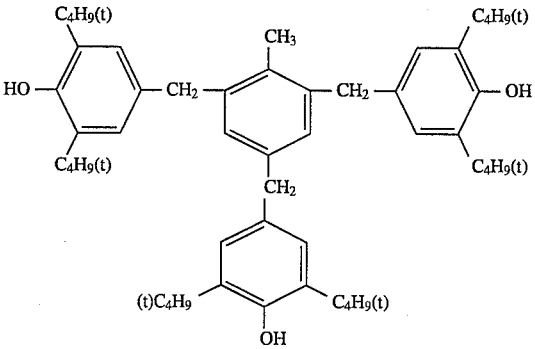

II-6

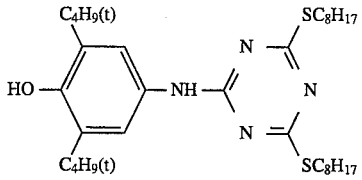

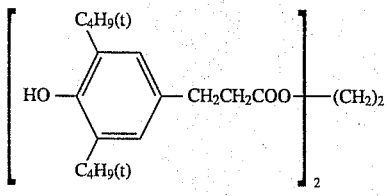
-continued
II-7
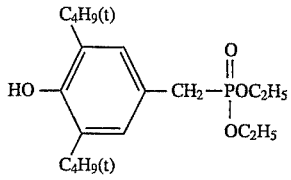
II-8
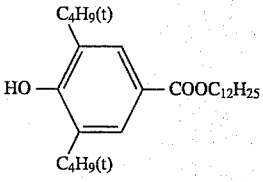
II-9
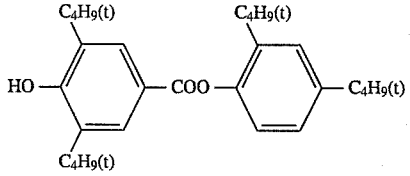
II-10
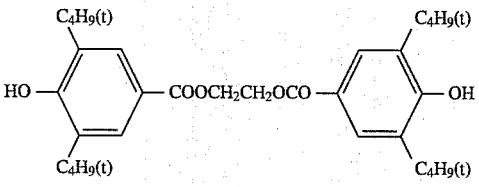
II-11
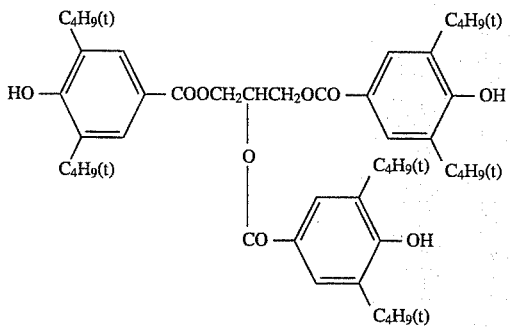
II-12
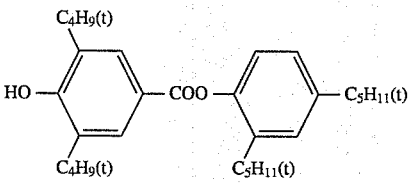
II-13
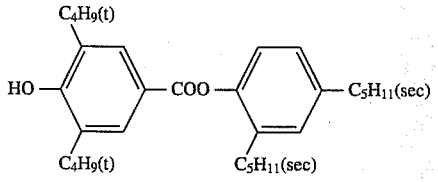
II-14
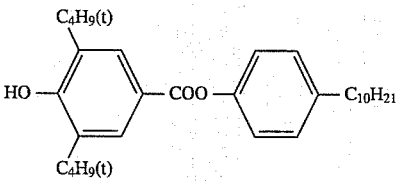
II-15
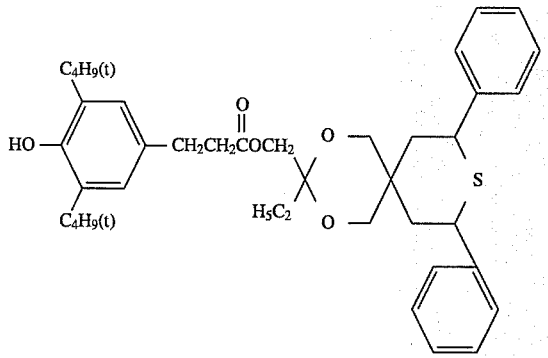
II-16
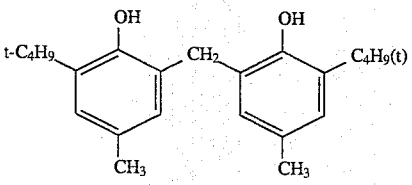
II-17
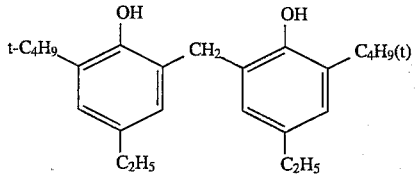
II-18
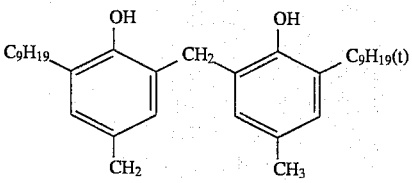
II-19
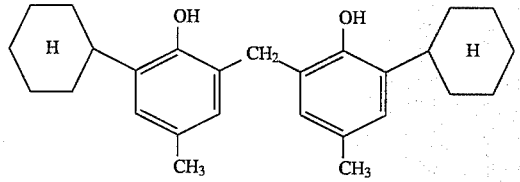
II-20

-continued
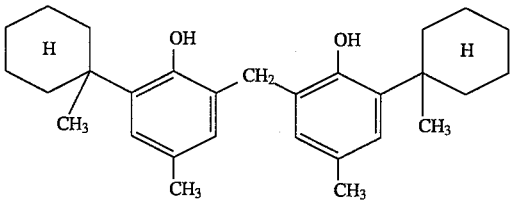
II-21
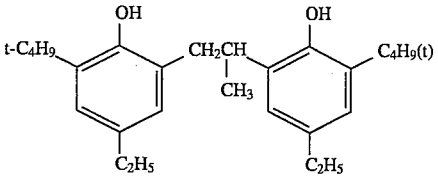
II-22
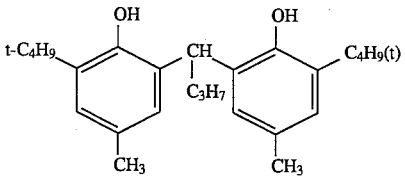
II-23
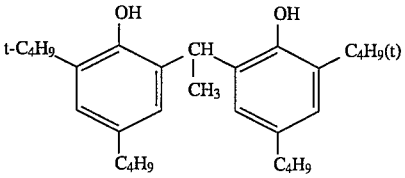
II-24
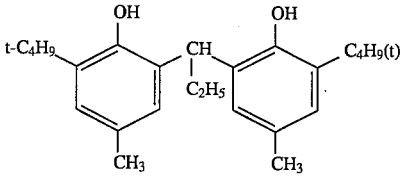
II-25
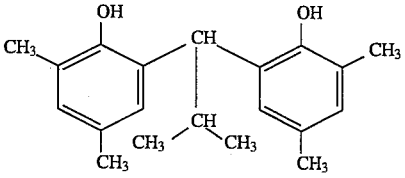
II-26
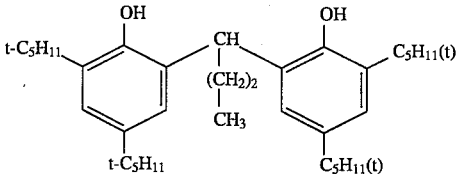
II-27
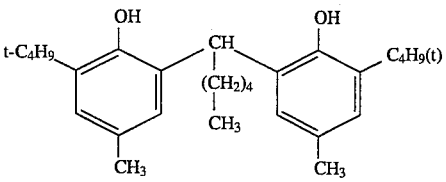
II-28
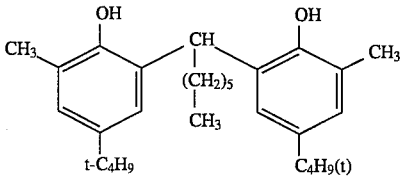
II-29
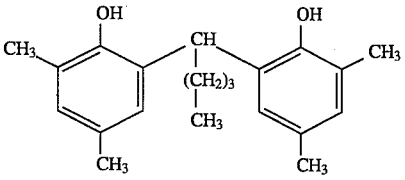
II-30
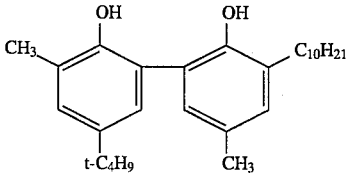
II-31
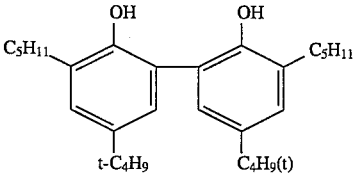
II-32
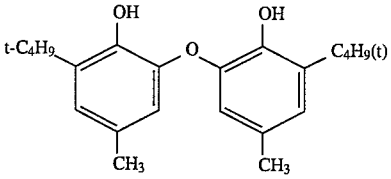
II-33
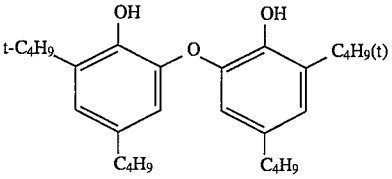
II-34
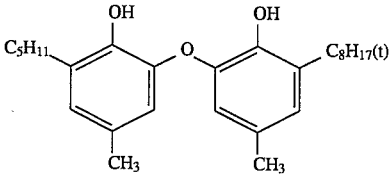
II-35
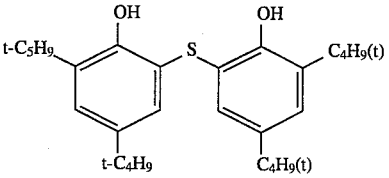
II-36
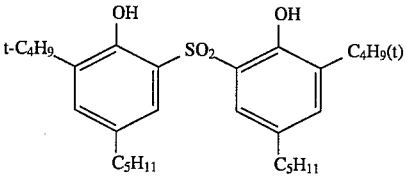
II-37
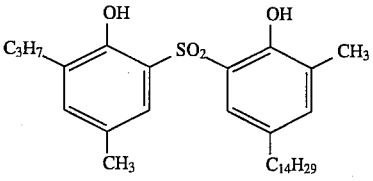
II-38

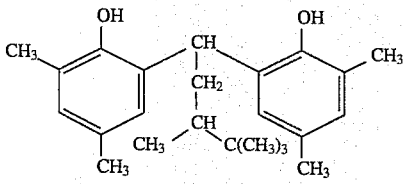
-continued
II-39
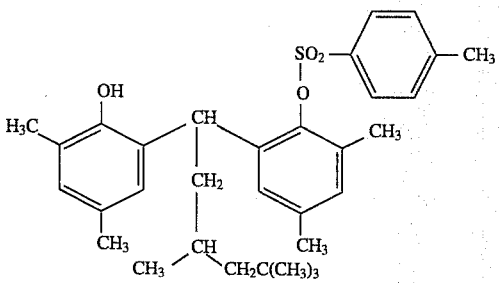
II-40
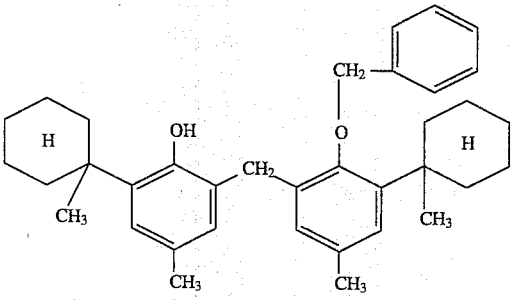
II-41
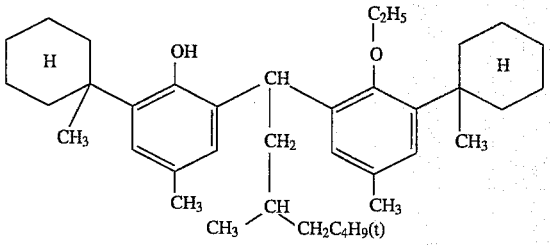
II-42
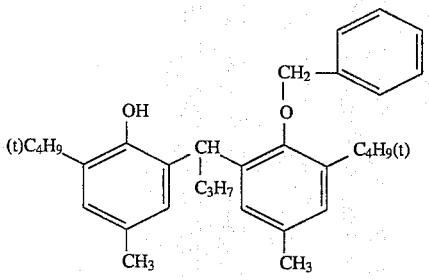
II-43
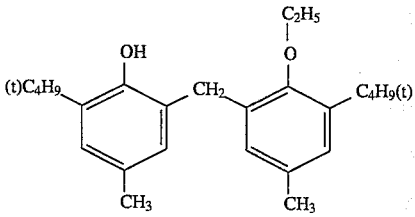
II-44
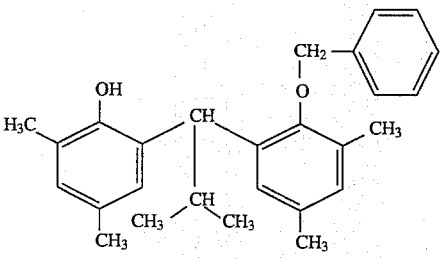
II-45
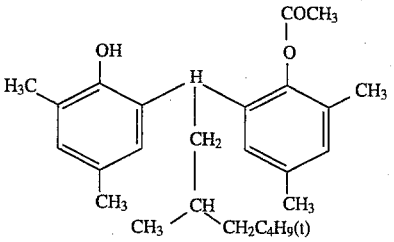
II-46
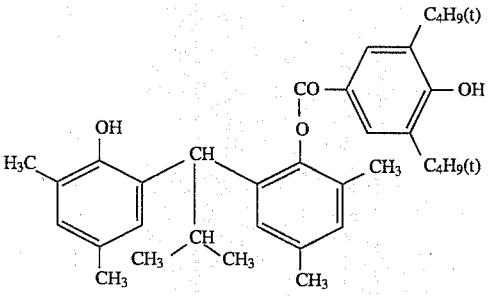
II-47
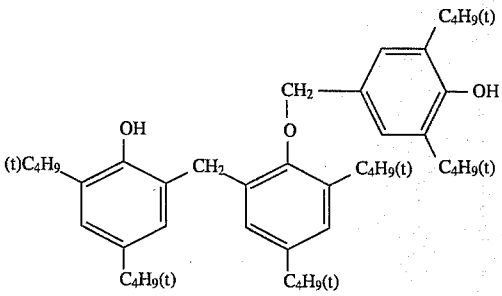
II-48

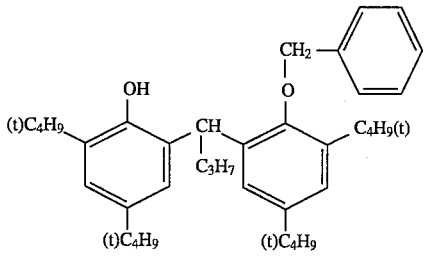
-continued
II-49
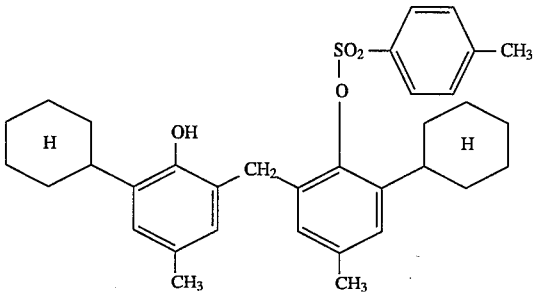
II-50
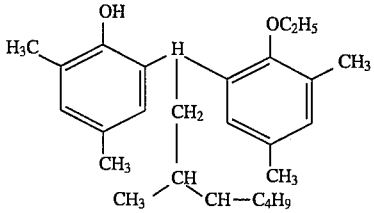
II-51
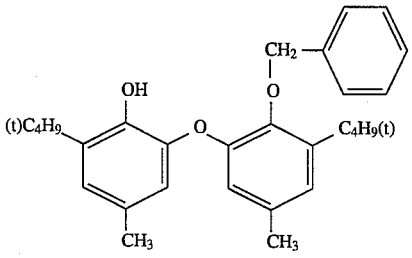
II-52
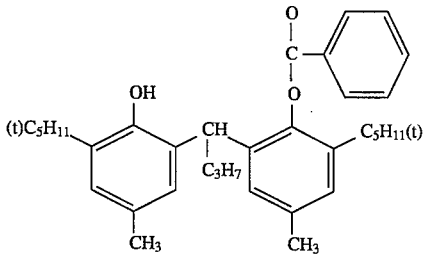
II-53
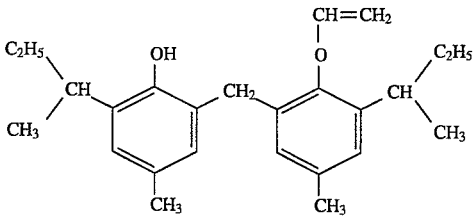
II-54
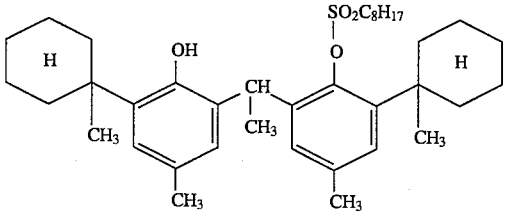
II-55
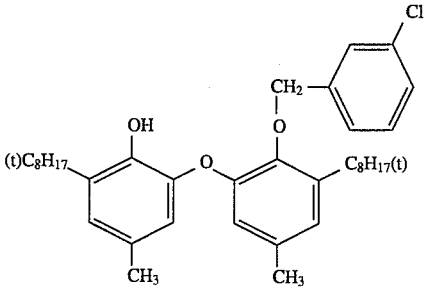
II-56
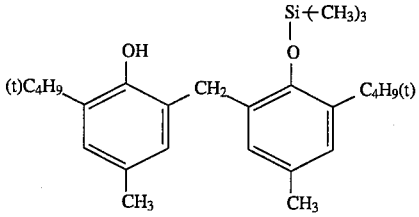
II-57
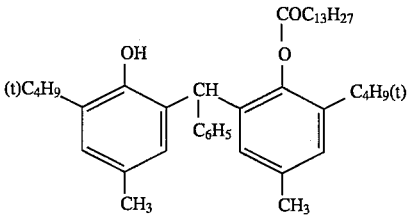
II-58
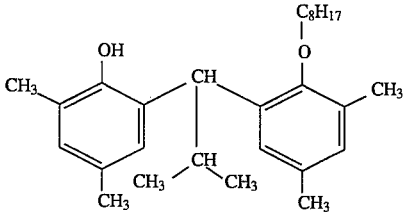
II-59
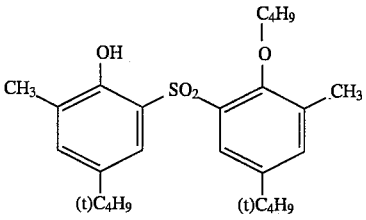
II-60

-continued
II-61
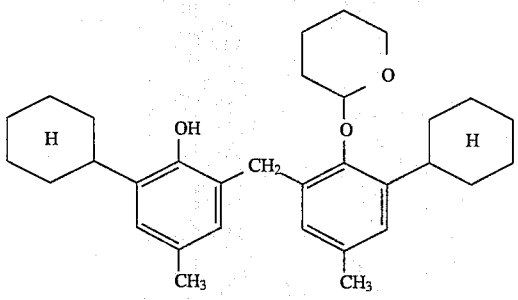
II-62
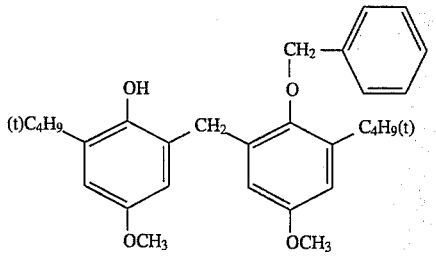
II-63
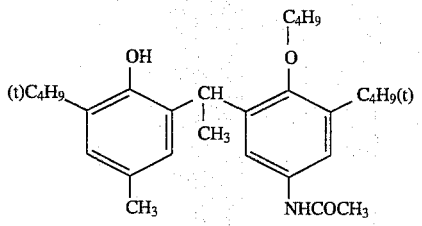
II-64
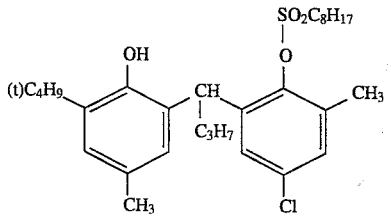
II-65
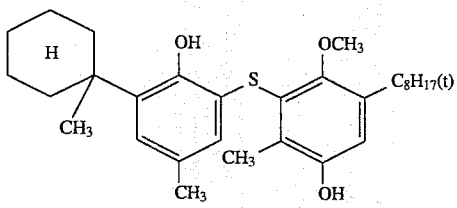
II-66
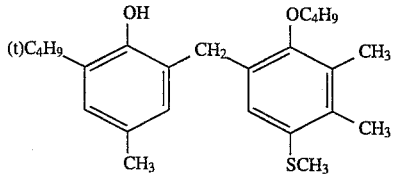
II-67
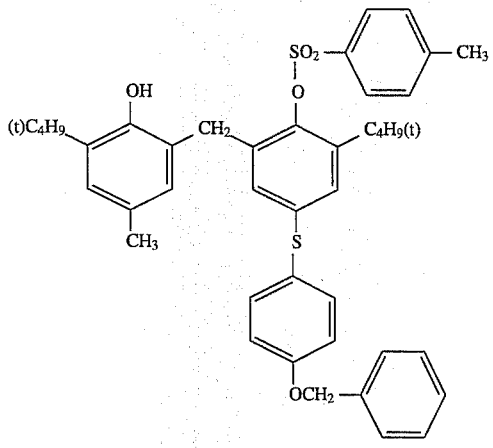
II-68
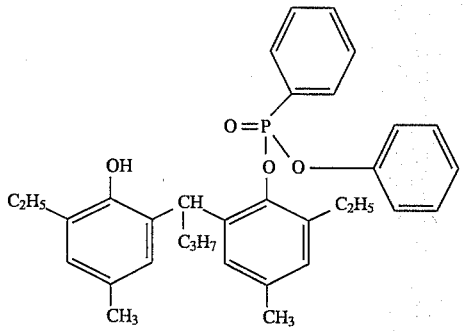
II-69
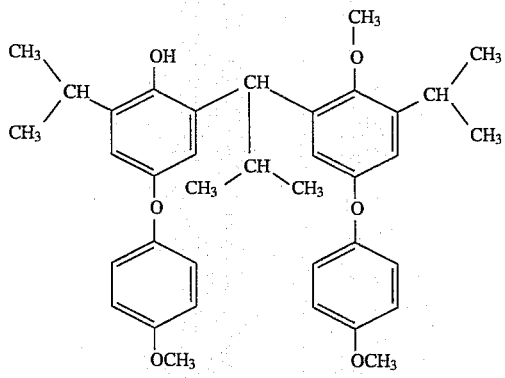
II-70
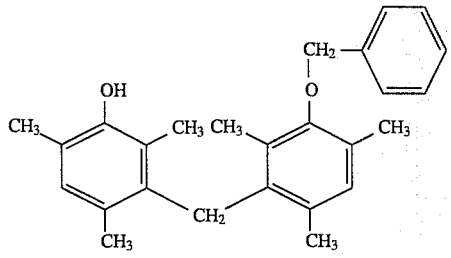

-continued
II-71
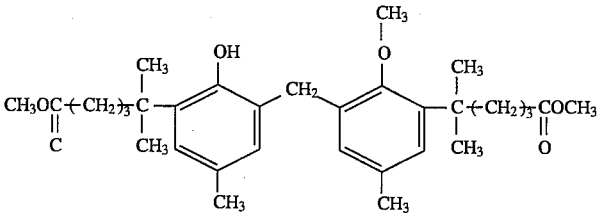
II-72
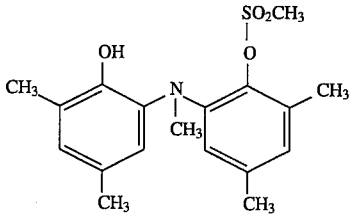
II-73
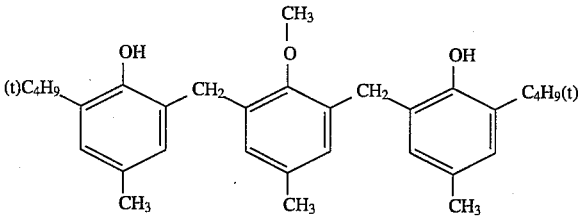
II-74
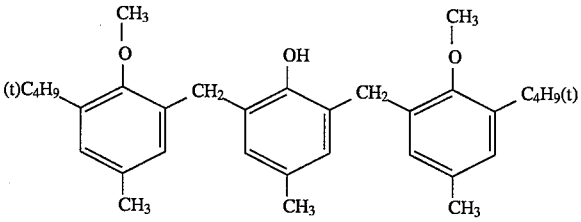
II-75
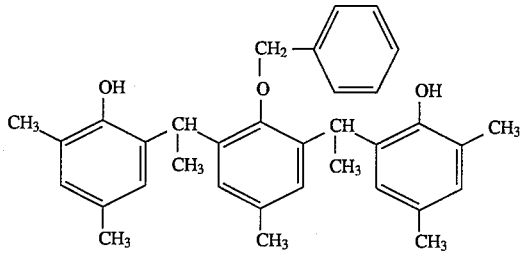
II-76
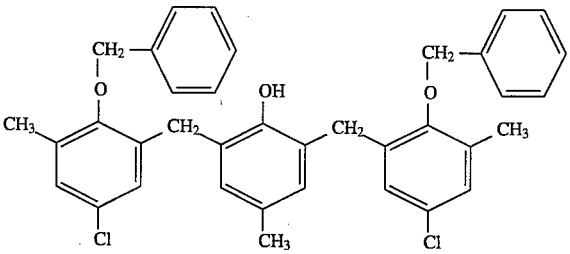
II-77
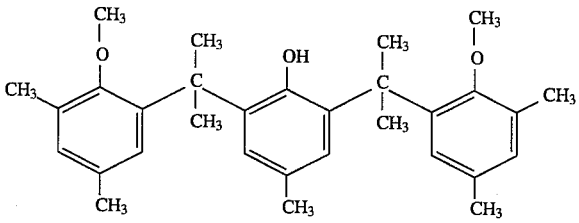

-continued
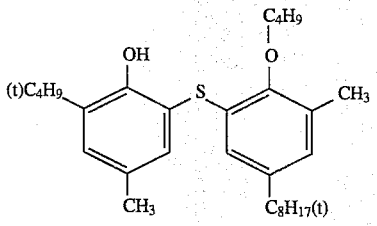
II-78
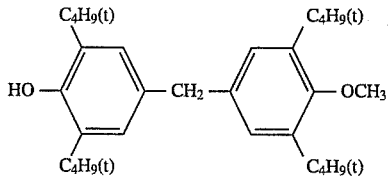
II-79
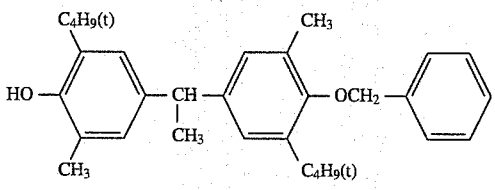
II-80
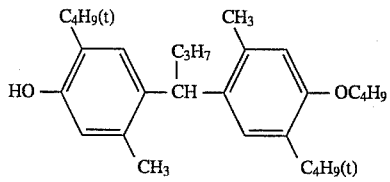
II-81
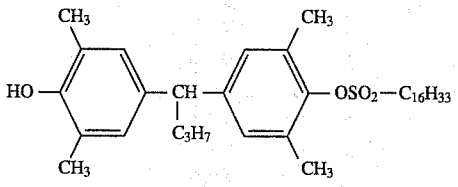
II-82
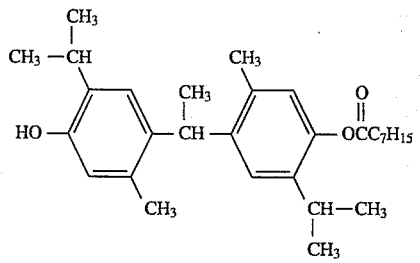
II-83
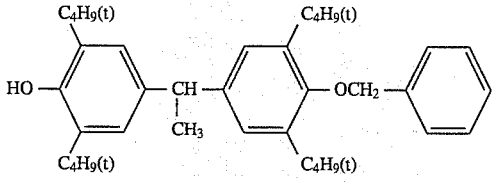
II-84
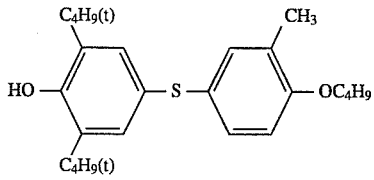
II-85
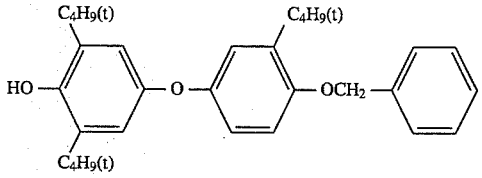
II-86
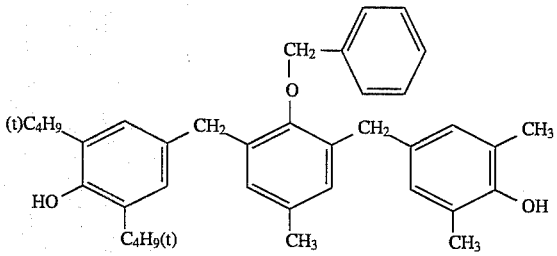
II-87
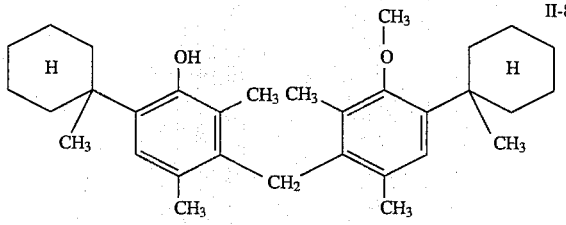
II-88
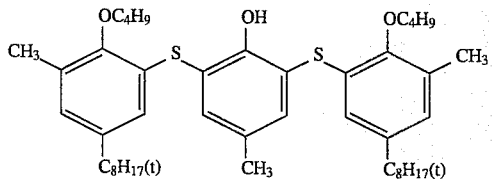
II-89

-continued
II-90
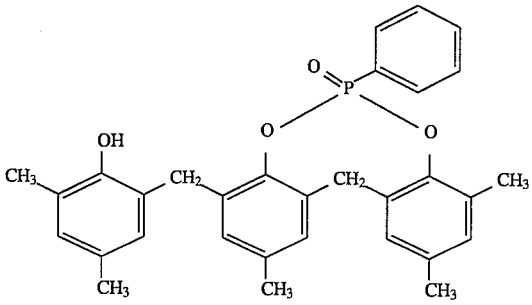
II-91
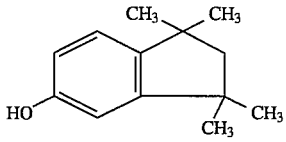
II-92
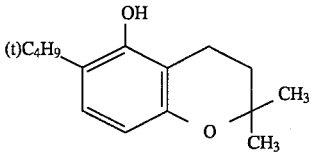
II-93
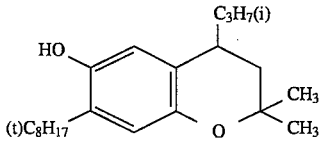
II-94
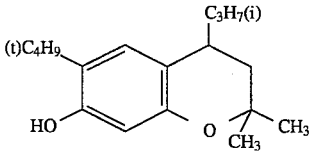
II-95
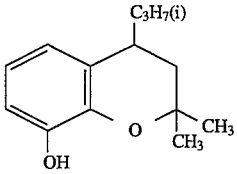
II-96
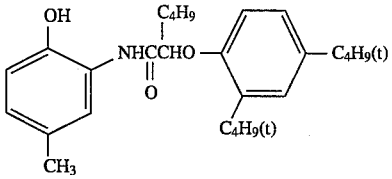
II-97
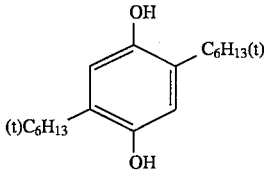
II-98
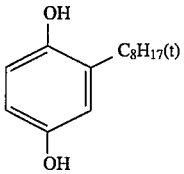
II-99
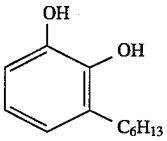
II-100
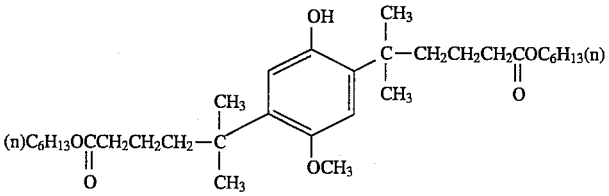
II-101
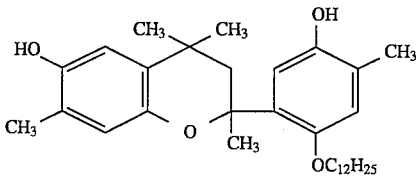
II-102
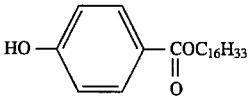
II-103
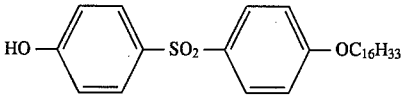
II-104
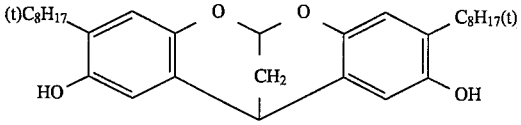

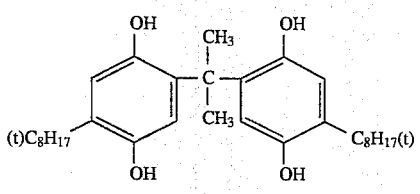
-continued
II-105
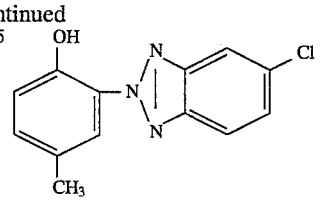
II-106
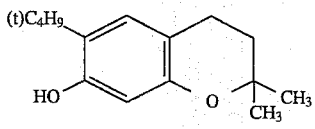
II-107
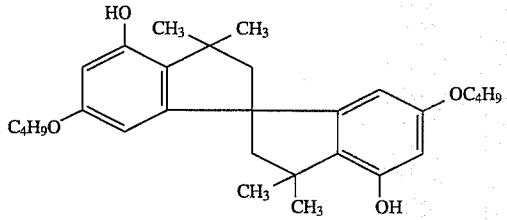
II-108
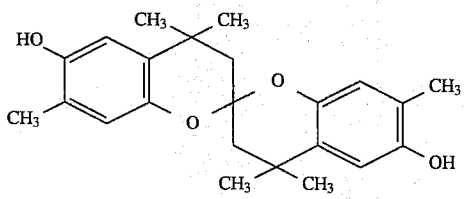
II-109
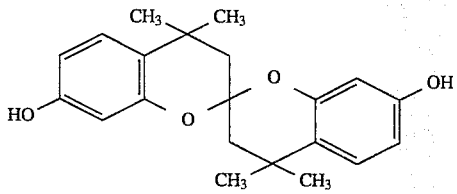
II-110
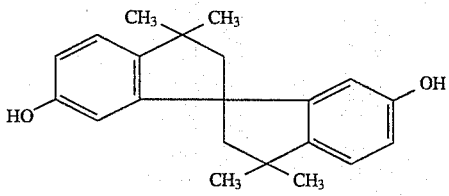
II-111
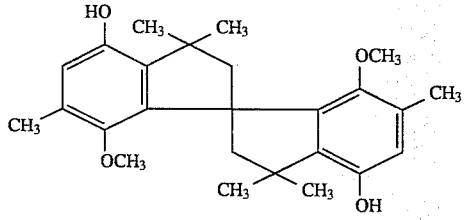
II-112
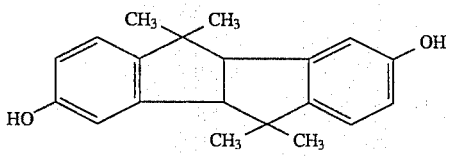
II-113
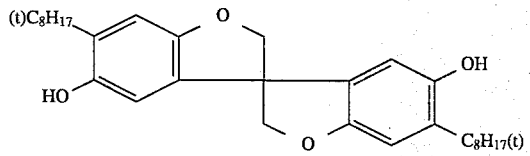
II-114
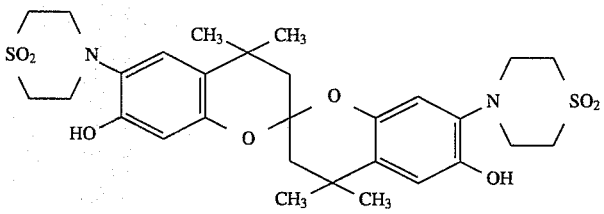
II-115
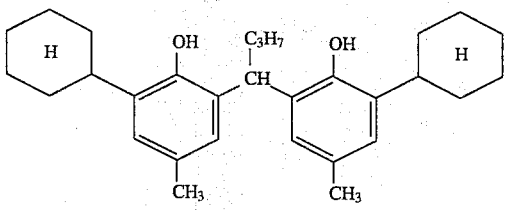
II-116
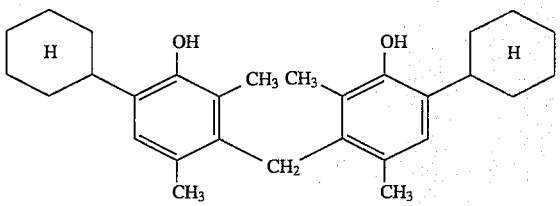
II-117

The compound represented by formula (III) will now be described below.

The alkyl group, the alkenyl group, and the alkynyl group represented by $R_3$ may be straight-chain, branched chain, or cyclic and may be substituted. The substituent may be those capable of substitution. The alkyl group includes, for example, a methyl group, an ethyl group, a butyl group, an octyl group, a hexadecyl group, and a benzyl group and preferably has a total C-number of 1 to 12. The alkenyl group includes, for example, a vinyl group and an allyl group and preferably has a total C-number of 2 to 16. The alkynyl group includes, for example, an ethynyl group and a 2-propyl group and preferably has a total C-number of 2 to 16.

The alkyl group represented by $R_4$ and $R_4'$ may be straight-chain, branched chain, or cyclic and may be substituted. The substituent may be those capable of substitution. The aryl group represented by $R_4'$ may be substituted and the substituent may be those capable of substitution. The monovalent organic group represented by $R_4''$ includes, for example, an alkyl group, an alkenyl group, an alkoxy group, an aryloxy group, an alkylamino group, and an arylamino group. Each of $R_4$, $R_4'$, and $R_4''$ has a total C-number of 16 or less. More particularly, —$OR_4$ represents, for example, a hydroxyl group, an alkoxy group, or a cycloalkyloxy group. —$SOR_4'$ represents, for example, an alkylsulfinyl group, or an arylsulfinyl group, —$SO_2R_4'$ represents, for example, an alkylsulfonyl group or an arylsulfonyl group, and —$COR_4''$ represents, for example, an acyl group or an alkoxycarbonyl group.

$R_3$ preferably represents a hydrogen atom, an alkyl group, an alkenyl group, an alkynyl group, an alkoxy group, or an acyl group.

The alkyl group represented by $R_5'$ and $R_5''$ is a straight-chain or branched chain alkyl group or a cycloalkyl group formed by $R_5'$ together with $R_5''$ and preferably a straight-chain or branched chain alkyl group having 1 to 5 carbon atoms, particularly preferably a methyl group.

B represents a group of non-metallic atoms required to form a 5- to 7-membered ring and the heterocyclic ring formed by B is, for example, a piperazine ring, a morpholine ring, a piperidine ring, and a pyrrolidine ring, preferably a saturated ring, more preferably a 6-membered ring, and further more preferably a piperazine ring, a morpholine ring, or a piperidine ring. Most preferably B represents a group of atoms required to form a piperidine ring.

In the present invention, preferably the compound represented by formula (III) is one represented by the following formula (IIIA):

Formula (IIIA)

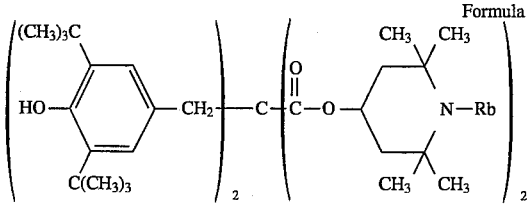

wherein Rb represents an alkyl group, an alkenyl group, an alkynyl group, or an acyl group, more preferably a methyl group, an ethyl group, a vinyl group, an ally group, a propenyl group, a benzyl group, an acetyl group, a propionyl group, an acryloyl group, a methacryloyl group, or a crotonoyl group.

Specific compounds represented by formula (III) are shown below, but the present invention is not restricted to them.

Further, in the present invention, preferably the compound represented by formula (III) is one represented by the following formula (IIIB):

Formula (IIIB)

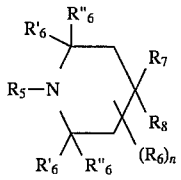

wherein $R_5$ represents a hydrogen atom, a hydroxyl group, an oxy radical group, —$SOR'_5$, —$SO_2R'_5$ (wherein $R'_5$ represents an alkyl group or an aryl group), an alkyl group, an alkenyl group, an alkynyl group, an alkoxy group, or —$COR''_5$ (wherein $R''_5$ represents a hydrogen atom or a monovalent organic group), $R_6$, $R'_6$, and $R''_6$ each represent an alkyl group, $R_7$ and $R_8$ each represent a hydrogen atom or —OCOR''' (wherein R''' represents a monovalent organic group), $R_7$ and $R_8$ together may form a heterocyclic ring, and n is an integer of 0 to 4.

Examples of compounds of formula (III) are as follows:

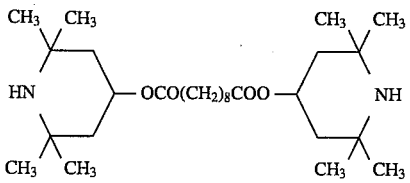

III-1

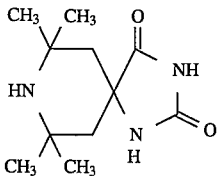

III-2

-continued
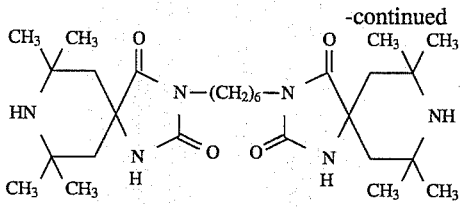
III-3
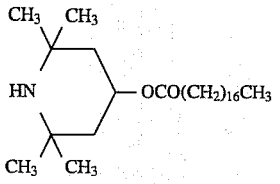
III-4
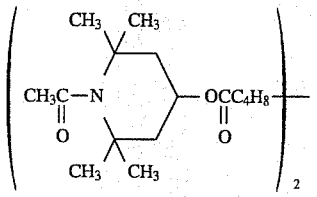
III-5
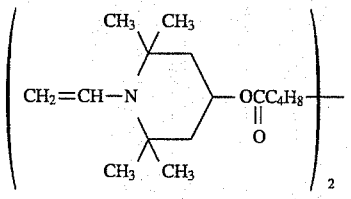
III-6
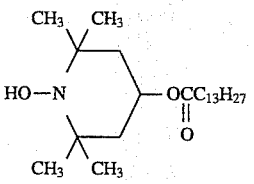
III-7
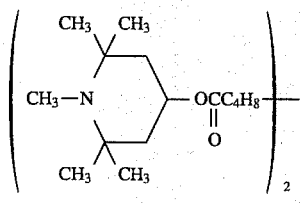
III-8
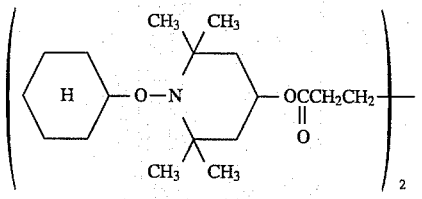
III-9
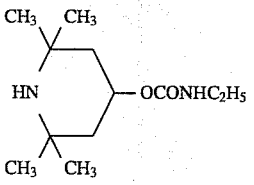
III-10
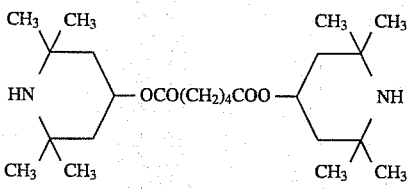
III-11

-continued
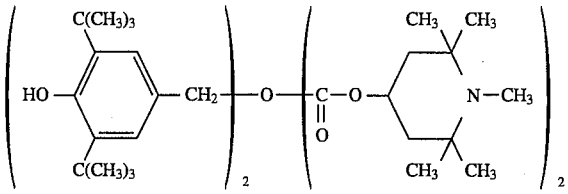
III-12
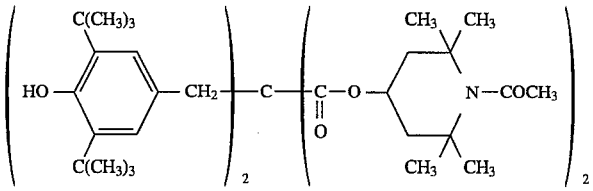
III-13
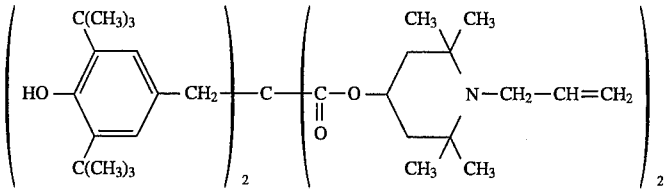
III-14
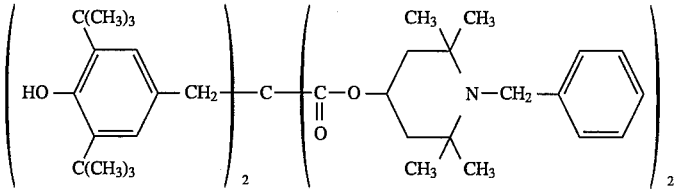
III-15
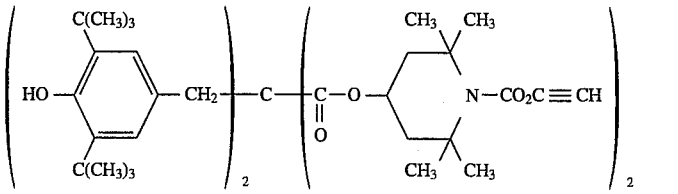
III-16
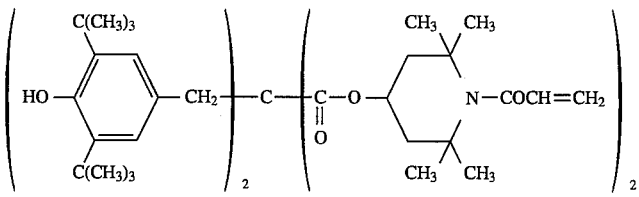
III-17
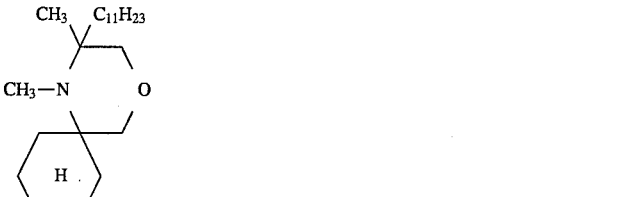
III-18
III-19
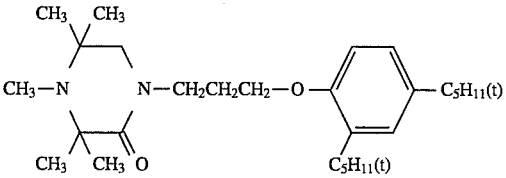

-continued

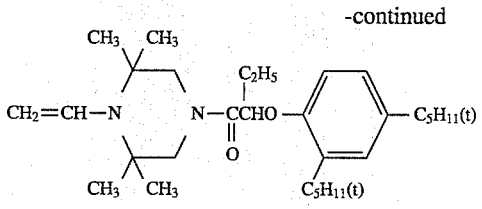

III-20

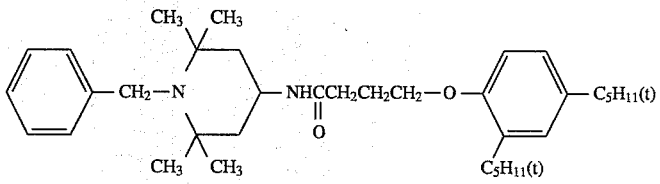

III-21

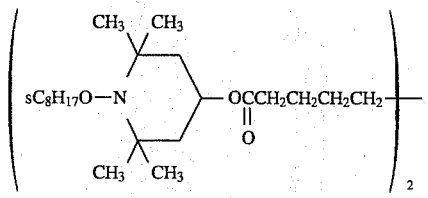

III-22

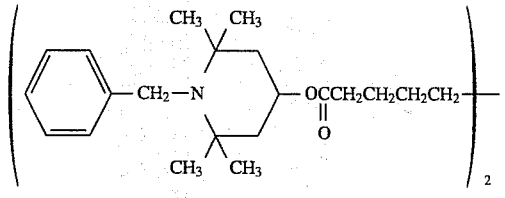

III-23

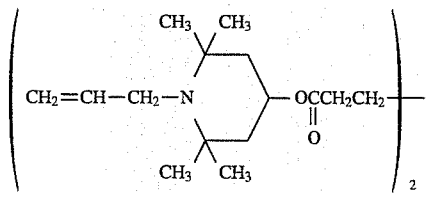

III-24

The amounts of the present yellow coupler and the compound represented by formula (II) or (III) are used such that the compound is contained in an amount generally in the range of 0.01 to 2.0 mol, preferably in the range of 0.1 to 1.0 mol, per mol of the coupler. Although the compound represented by formula (II) or (III) can be added to an arbitrary layer, preferably the compound is added to the layer containing the present yellow coupler or a layer adjacent to it, more preferably to the layer containing the present yellow coupler.

Preferably the compounds represented by formulae (II) and (III) are added in the same way as that of the addition of the coupler; that is, the compounds represented by formulae (II) and (III) are dissolved in a high-boiling organic solvent for couplers, and if necessary a low-boiling organic solvent (co-solvent), and are emulsified and dispersed into an aqueous gelatin solution. If the compounds represented by formulae (II) and (III) are added to the layer containing the yellow coupler, preferably the compounds are co-emulsified with the yellow coupler. If the compounds are emulsified and dispersed together with a water-insoluble polymer as described below, the use of a high-boiling organic solvent is not required.

Although, as a silver halide used in the present invention, for example, silver chloride, silver bromide, silver bromo(iodo)chloride, and silver bromoiodide can be used, particularly if rapid processing is intended, a silver chloride emulsion or a silver bromochloride emulsion substantially free from silver iodide and having a silver chloride content of 90 mol % or more, preferably 95 mol % or more, particularly preferably 98 mol % or more, is used preferably.

In the photographic material according to the present invention, in order to improve, for example, sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt. % or more (preferably 14 wt. % or more) of titanium oxide the surface of which has been treated with secondary to quaternary alcohol (e.g., trimethylolethane) or the like is contained in a water-resistant resin layer of the base.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in JP-A No. 215272/1987, from page 137 (right lower column) to page 144 (right upper column).

To emulsify and disperse the cyan, magenta, or yellow coupler into a hydrophilic colloid, a method can be used wherein the coupler is impregnated into a loadable latex polymer (e.g., see U.S. Pat. No. 4,203,716)in the presence or absence of the above high-boiling organic solvent, but preferably a method is used wherein the coupler is dissolved together with a polymer insoluble in water but soluble in organic solvents in the presence or absence of the above-mentioned high-boiling organic solvent and the solution is emulsified and dispersed into an aqueous hydrophilic colloid solution.

In the present invention, a photographically useful substance that has been retained in the state of a solution by any one of the below-mentioned methods is mixed, in the presence of a surface-active polymer, with water or an aqueous hydrophilic colloid solution, so that a dispersion of the photographically useful finely divided substance is prepared. If necessary, to make the size of the particles of the dispersion more fine, one of dispersing machines as described below may be used.

As an emulsifier used for carrying out the present invention, for example, a high-speed stirring-type dispersing machine having a great shearing force and a dispersing machine that can give high-strength ultrasonic energy can be mentioned. Specifically, a colloid mill, a homogenizer, a capillary tube-type emulsifier, a liquid silen, an electromagnetic stress-type ultrasonic generator, and an emulsifier with a Porman-whistile can be mentioned. A high-speed stirring-type disperser which is preferably used in the present invention is of a type wherein the essential part for the dispersion is turned at a high speed (e.g., 500 to 15,000 rpm, preferably 2,000 to 4,000 rpm) and examples thereof are Dissolver, Polytron, Homomixer, Homoblender, KD-Mill, and Jet-agitor. The high-speed stirring type disperser to be used in the present invention is called a dissolver or high-speed impeller disperser, and a preferable example is one provided with an impeller having serrated blades turned up and down alternatively and attached to a shaft that is rotated at a high speed, as described in JP-A No. 129136/1980.

To make dispersion particles fine, for example, a method described in European Patent No. 361322, wherein a solution of a compound to be dispersed and a water-miscible organic solvent is mixed with an aqueous hydrophilic colloid solution to deposit dispersion particles; methods described in European Patent No. 374837 and International Publication WO 90/16011, wherein an aqueous alkali solution of a compound to be dispersed is neutralized with an acid to deposit dispersion particles; and a method described in International Publication WO 91/08516, wherein an oil-in-water dispersion of a compound to be dispersed is absorbed to a polymer dispersion, can be preferably used.

Preferably, homopolymers and copolymers described in U.S. Pat. No. 4,857,449 and International Publication WO 88/00723, pages 12 to 30, are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

In the photographic material according to the present invention, various anti-fading agent can be used. That is, as organic anti-fading agents for cyan, magenta and/or yellow images, hydroquinones, 6-hydroxychromans, 5-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

As specific examples of the organic anti-fading agents can be mentioned hydroquinones as described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans as described, for example, in U.S. Pat. Nos. 3,432,300, 3,573,050, 3,574,627, 3,698,909, and 3,764,337 and JP-A No.152225/1987; spiroindanes as described in U.S. Pat. No. 4,360,589; p-alkoxyphenols as described, for example, in U.S. Pat. No. 2,735,765, British Patent No. 2,066,975, JP-A No. 10539/1984, and JP-B No. 19765/1982; hindered phenols as described, for example, in U.S. Pat. Nos. 3,700,455 and 4,228,235, JP-A No. 72224/1977, and JP-B No. 6623/1977; gallic acid derivatives as described, for example, in U.S. Pat. No. 3,457,079; methylene-dioxybenzenes as described, for example, in U.S. Pat. No. 4,332,886; aminophenols as described, for example, in JP-B No. 21144/1981; hindered amines as described, for example, in U.S. Pat. Nos. 3,336,135 and 4,268,593, British Patent Nos. 1,326,889, 1,354,313, and 1,410,846, JP-B No. 1420/1976, and JP-A Nos. 114036/1983, 53846/1984, and 78344/1984; and metal complexes as described, for example, in U.S. Pat. Nos. 4,050,938 and 4,241,155, and British Patent 2,027,731(A). To attain the purpose, these compounds can be added to the photosensitive layers by coemulsifying them with the corresponding couplers, with the amount of each compound being generally 5 to 100 wt. % for the particular coupler.

When the photographic material of the present invention is a direct positive color photographic material, nucleating agents, such as hydrazine series compounds and quaternary compounds described, for example, in Research Disclosure No. 22534 (January 1983) and nucleation accelerators that will promote the effect of such nucleating agent, can be used.

As a colored coupler to rectify the unnecessary absorption of color-forming dyes, those couplers described in paragraph VII-G of Research Disclosure No. 17643, U.S. Pat. No. 4,163,670, JP-B No. 39413/1982, U.S. Pat. Nos. 4,004,929, and 4,138,258, British Patent No. 1,146,368 are preferable. Further, it is preferable to use couplers to rectify the unnecessary absorption of color-forming dye by fluorescent dye released upon the coupling described in U.S. Pat. No. 4,774,181 and couplers having a dye precursor, as a group capable of being released, that can react with the developing agent to form a dye described in U.S. Pat. No. 4,777,120.

As a coupler which forms a dye having moderate diffusibility, those described in U.S. Pat. No. 4.366,237, British Patent No. 2,125,570, European Patent No. 96,570, West German Patent Application (OLS) No. 3,234,533 are preferable.

Typical examples of a polymerized dye-forming coupler are described in U.S. Pat. Nos. 3,451,820, 4,080,211, 4,367,282, 4,409,320, and 4,576,910, and British Patent No. 2,102,173.

A coupler that releases a photographically useful residue accompanied with the coupling reaction can be used favorably in this invention. As a DIR coupler that releases a development retarder, those described in patents cited in paragraph VII-F of the above-mentioned Research Disclosure No. 17643, JP-A Nos. 151944/1982, 154234/1982, 184248/1985, and 37346/1988, and U.S. Pat. Nos. 4,286,962 and 4,782,012 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of this invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox described in JP-A Nos. 185950/1985 and 24252/1987, couplers which release a dye to regain a color after releasing described in European Patent No. 173,302A, couplers which release a bleaching-accelerator described in RD. Nos. 11449 and 24241, and JP-A No. 201247/1986, couplers which release a ligand described in U.S. Pat. No. 4,553,477, couplers which release a leuco dye described in JP-A No. 75747/1988, and couplers which release a fluorescent dye described in U.S. Pat. No. 4,774,181.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support(base) to be used for the photographic material of this invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the support is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional black-and-white development processing or color processing, and in a case of a color photographic material, preferably it is subjected to color development processing and then is bleached and fixed for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publication, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column 6 to p. 12 lower left column line 5, and p. 12 lower right column 4 from the bottom to p. 13 upper left column line 17 | line p. 28 upper right column line 16 to p. 29 lower right column line 11 and line p. 30 lines 2 to 5 | p. 45 line 53 to p. 47 line 3 and p. 47 lines 20 to 22 |
| Solvent for silver halide | p. 12 lower left column line 6 to 14 and p. 13 upper left colunln line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing | p. 22 upper right column line 8 from the bottom to p. 38 | p. 30 upper left column lines 1 to 13 | p. 47 lines 10 to 15 |

-continued

| Element constituting photographic material | JP-A No. 215272/1987 | JP-A No. 33144/1990 | EP 0,355,660A2 |
|---|---|---|---|
| agent (method) | last line | | |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right coulumn line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | | |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower ringt column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the botom to lower right column line 9 | — |
| Fluorine-containing agent (As Antistatic agent, coating aid, lubricant, adhesion | p. 210 lower left column line 1 to p. 222 lower left column line 5 | p. 25 upper left column line 1 to p. 27 lower right column line 9 | |

-continued

| Element constituting photographic material | JP-A No. 215272/1987 | JP-A No. 33144/1990 | EP 0,355,660A2 |
|---|---|---|---|
| inhibitor, or the like) | | | |
| Binder (Hydrophilic colloid) | p. 222 lower left column 6 to p. 225 upper left dolumn last line | line p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 21572/1987, amendment filed on March 16, 1987 is included.

Further, as cyan couplers, diphenylimidazole cyan couplers described in JP-A No. 33144/1990, as well as 3-hydroxypyridine cyan dye-forming couplers described in European Patent EP 0,333,185A2 (in particular one obtained by causing Coupler (42), which is a four-equivalent coupler, to have a chlorine coupling split-off group, thereby rendering it to two-equivalent, and Couplers (6) and (9), which are listed as specific examples, are preferable) and cyclic active methylene cyan dye-forming couplers described in JP-A No. 32260/1989 (in particular, specifically listed Coupler Examples 3, 8, and 34 are preferable) are preferably used.

As a method for color development processing of a photographic material using a high-silver-chloride emulsion having silver chloride content of 90 mol % or more, the method described in, for example, JP-A No. 207250/1990, page 27 (the left upper column) to page 34 (the right upper column), is preferably used.

According to the silver halide color photographic material of the present invention, a photographic material excellent in the color-forming property of a coupler, the spectral absorption characteristics of a yellow color-formed dye, and its fastness, can be provided.

In addition, in this case, other photographic characteristics, including typically fastness to heat and humidity and emulsion stability, are not adversely influenced.

According to the present invention, in comparison with the case using conventional benzoyl-type acylacetamide couplers or pivaloyl-type acylacetamide yellow couplers, the major absorption of the yellow dye is on the short wavelength side and the subsidiary absorption on the long wavelength side is relatively small, so that a color photograph good in color reproduction can be obtained.

The present invention will be described in more detail in accordance with Examples, but the invention is not limited to these Examples.

Example 1

A yellow color-forming monolayer photographic material No. 1 was prepared by coating three layers that consists of an emulsion layer, an UV absorbing layer, and a protecting layer, compositions of which are shown below, on a prime-coated triacetate cellulose base. Figures shown represent each coating amount (in g/m$^2$), and the coating amount of silver halide emulsion is shown in terms of silver.

| | |
|---|---|
| First layer (Blue-sensitive emulsion layer) | |
| Silver chlorobromide emulsion | 0.30 |
| Gelatin | 1.86 |
| Yellow coupler (Ex$Y_1$) | 0.82 |
| Tricresyl phosphate | 0.41 |
| Second layer (UV absorbing layer) | |
| Gelatin | 0.53 |
| UV absorbent (UV-1) | 0.15 |
| Dibutyl phthalate | 0.08 |
| Third layer (Protective layer) | |
| Gelatin | 1.33 |
| Acryl-modified copolymer of polyvinyl alcohol (modification degree: 17%) | 0.17 |
| Liquid paraffin | 0.03 |

Coating solutions of respective layers were prepared in an usual manner. As a gelatin hardener, 1-oxy-3,5-dichloro-s-triazinic acid sodium salt was used in each layer. The preparation method of coating solution will be described specifically with referring to the first layer solution.

Preparation of first layer coating solution

To 19.1 g of yellow coupler (Ex$Y_1$), 27.2 ml of ethyl acetate and 9.5 g of tricresyl phosphate were added and dissolved. The resulting solution was dispersed and emulsified in 185 ml of 10% aqueous gelatin solution containing 8 ml of sodium dodecylbenzenesulfonate. Separately silver chlorobromide emulsion (cubic grains, 3:7 (silver mol ratio) blend of grains having 0.88 μm and 0.70 μm of average grain size, and 0.08 and 0.10 of deviation coefficient of grain size distribution, respectively, each in which 0.3 mol % of silver bromide was located at the surface of grains) was prepared. Blue-sensitive sensitizing dyes A and B, shown below, were added in this emulsion in such amounts that each dye corresponds $2.0\times10^{-4}$ mol to the large size emulsion and $2.5\times10^{-4}$ mol to the small size emulsion, per mol of silver, respectively. The chemical ripening of this emulsion was carried out by adding sulfur and gold sensitizing agents. The above-described emulsified dispersion and this emulsion were mixed together and dissolved, thereby preparing the first layer coating solution.

Sensitizing dye A for blue-sensitive emulsion layer

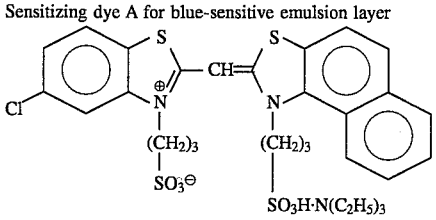

Sensitizing dye B for blue-sensitive emulsion layer

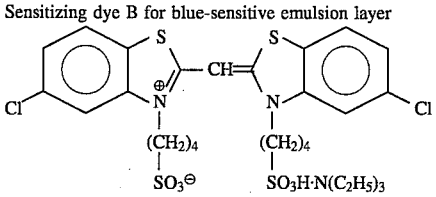

Next, Samples Nos. 2 to 22 were prepared by the same manner as Sample No. 1, except that the yellow coupler was changed to each of yellow couplers of the present invention, and image dye stabilizer S of the present invention was added in an amount of 20 mol % for the coupler.

Each of samples Nos. 1 to 22 thus-prepared was subjected to a gradation exposure to light through three color separated filter for sensitometry using a sensitometer (FWH model made by Fuji Photo Film Co., Ltd., the color temperature of light source was 3200K). At that time, the exposure was carried out in such a manner that the exposure amount was 250 CMS with the exposure time being 0.1 sec.

After exposure to light, each sample was subjected to a processing according to the processing process shown below.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material.
Rinsing steps were carried out in 3-tanks countercurrent mode from the tank of rinsing (3) toward the tank of rinsing (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | 400 ml | |
| Ammonium thiosulfate (70 g/l) | 100 ml | |
| Sodium sulfite | 17 g | |
| Iron (III) ammonium ethylenediamine-tetraacetate dehydrate | 55 g | |
| Disodium ethylenediaminetetraacetate | 5 g | |
| Ammonium bromide | 40 g | |
| Water to make | 1000 ml | |
| pH (25° C.) | 6.0 | |
| Rinse solution (Both tank solution and replenisher) | | |
| Ion-exchanged water (calcium and magnesium each are 3 ppm or below) | | |

For the thus-processed samples, transmission absorption spectra was measured, and maximum absorption wavelength (max) at the absorbance of 1.0, and the difference between the wavelength that gives a density of 0.a or 0.1 and λmax ($\Delta\lambda_{0.5}$ and $\Delta\lambda_{0.1}$) were determined.

Results are shown in Table 1.

TABLE 1

| Sample No. | Yellow Coupler | Image-dye Stabilizer S | Spectral Absorption Characterics λ max/nm | $\Delta\lambda_{0.5}$ | $\Delta\lambda_{0.1}$ | Remarks |
|---|---|---|---|---|---|---|
| 1 | $ExY_1$ | — | 445 | 41.8 | 79.3 | Comparative Example |
| 2 | Y-1 | — | 442 | 37.6 | 74.7 | " |
| 3 | Y-4 | — | 443 | 39.0 | 79.1 | " |
| 4 | Y-9 | — | 443 | 38.5 | 76.0 | " |
| 5 | Y-12 | — | 443 | 40.9 | 79.0 | " |
| 6 | Y-29 | — | 444 | 36.8 | 71.5 | " |
| 7 | Y-30 | — | 444 | 38.8 | 77.4 | " |
| 8 | Y-41 | — | 444 | 39.0 | 78.1 | " |
| 9 | $ExY_1$ | II-13 | 445 | 41.5 | 78.6 | " |
| 10 | " | III-1 | 445 | 41.5 | 78.5 | " |
| 11 | " | II-17 | 444 | 41.3 | 78.4 | " |
| 12 | " | II-44 | 444 | 41.6 | 78.3 | " |
| 13 | Y-1 | II-13 | 442 | 37.5 | 75.0 | This Invention |
| 14 | " | III-12 | 441 | 37.5 | 75.8 | " |

TABLE 1-continued

| Sample No. | Yellow Coupler | Image-dye Stabilizer S | Spectral Absorption Characterics λ max/nm | Δ $\lambda_{0.5}$ | Δ $\lambda_{0.1}$ | Remarks |
|---|---|---|---|---|---|---|
| 15 | " | II-17 | 442 | 37.4 | 75.2 | " |
| 16 | Y-12 | II-16 | 442 | 39.2 | 78.8 | " |
| 17 | " | III-17 | 442 | 39.5 | 79.1 | " |
| 18 | " | II-39 | 442 | 38.9 | 78.2 | " |
| 19 | Y-41 | II-1 | 444 | 39.1 | 78.0 | " |
| 20 | " | III-4 | 443 | 38.5 | 77.9 | " |
| 21 | " | II-39 | 443 | 39.2 | 78.3 | " |
| 22 | " | II-79 | 444 | 39.1 | 78.0 | " |

As is apparent from the results in Table 1, the yellow color-formed dye obtained from the acylacetoamide yellow coupler represented by formula (I) can give lower $\Delta\lambda_{0.5}$ and $\Delta\lambda_{0.1}$ than the comparative coupler and a sharp absorption spectrum that has $\lambda_{max}$ at short wavelength side and does not have unnecessary absorption. That is, it gives a yellow color-formed dye excellent in spectral absorption characteristics compared with the Comparative coupler $ExY_1$.

Further, when the image-dye stabilizer S represented by formula (II) or (III) is used in combination with these yellow couplers, the change of spectral absorption characteristics is not recognized, showing the excellent property of yellow color-formed dye obtained from the yellow dye-forming coupler of the present invention.

Example 2

A comparative sample 201 of multilayer photographic material having layer compositions shown below was prepared by coating various photographic constituting layers on a paper base laminated on both sides thereof with polyethylene film, followed by subjecting to a corona discharge treatment on the surface thereof, and provided a gelatin prime coat layer containing sodiumdodecylbenzenesulfonate. Coating solutions were prepared as follows:

Preparation of the first layer coating solution

To a mixture of 19.1 g of yellow coupler ($ExY_1$)and 0.7 g of image-dye stabilizer (Cpd-6)were added and dissolved 27.2 ml of ethyl acetate and each 4.1 g of solvents (Solv-3)and (Solv-7). The resulting solution was dispersed and emulsified in 185 ml of 10% aqueous gelatin solution containing 8 ml of sodium dodecylbenzenesulfonate, thereby prepared emulsified dispersion A. Separately silver chlorobromide emulsion A (cubic grains, 3:7 (silver molar ratio) blend of grains having 0.88 μm and 0.70 μm of average grain size, and 0.08 and 0.10 of deviation coefficient of grain size distribution, respectively, each in which 0.3 mol % of silver bromide was located at the surface of grains) was prepared. Blue-sensitive sensitizing dyes A and B, shown below, were added in this emulsion A in such amounts that each dye corresponds $2.0\times10^{-4}$ mol to the large size emulsion A and $2.5\times10^{-4}$ mol to the small size emulsion A, per mol of silver, respectively. The chemical ripening was carried out by adding sulfur and gold sensitizing agents. The above-described emulsified dispersion A and this emulsion A were mixed together and dissolved to give the composition shown below, thereby preparing the first layer coating solution.

Coating solutions for the second to seventh layers were also prepared in the same manner as the first layer coating solution. As a gelatin hardener for the respective layers, 1-hydroxy-3,5-dichloro-s-triazine sodium salt was used.

Further, Cpd-9 and Cpd-10 were added in each layer in such amounts that the respective total amount becomes 25.0 mg/m$^2$ and 50 mg/m$^2$.

As spectral-sensitizing dyes for the respective layers, the following compounds were used:

Sensitizing dye A for blue-sensitive emulsion layer

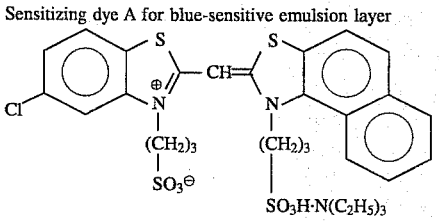

Sensitizing dye B for blue-sensitive emulsion layer

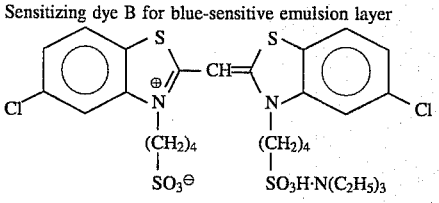

(each $2.0\times10^{-4}$ mol to the large size emulsion A and $2.5\times10^{-4}$ mol to the small size emulsion B, per mol of silver halide.)

Sensitizing dye C for green-sensitive emulsion layer

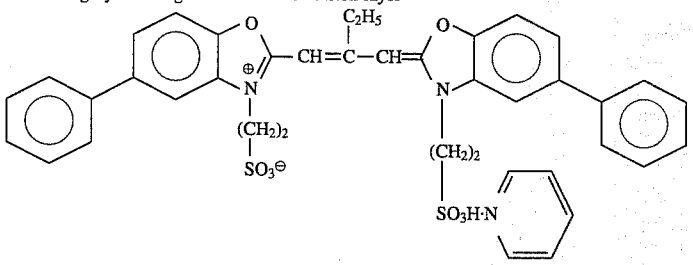

($4.0\times10^{-4}$ mol to the large size emulsion B and $5.6\times10^{-4}$ mol to the small size emulsion B, per mol of silver halide)

Sensitizing dye D for green-sensitive emulsion layer

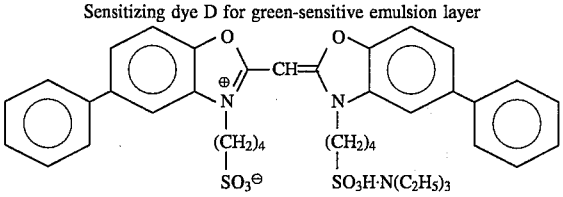

($7.0\times10^{-5}$ mol to the large size emulsion B and $1.0\times10^{-5}$ mol to the small size emulsion B, per mol of silver halide)

Sensitizing dye E for red-sensitive emulsion layer

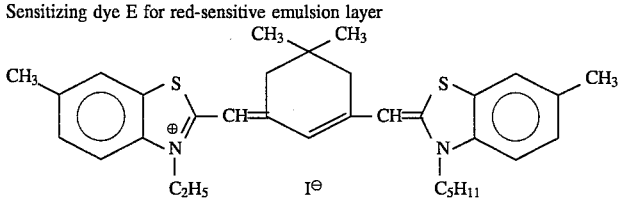

($0.9\times10^{-4}$ mol to the large size emulsion C and $1.1\times10^{-4}$ mol to the small size emulsion C, per mol of silver halide)

To the red-sensitive emulsion layer, the following compound was added in an amount of $2.6\times10^{-3}$ mol per mol of silver halide:

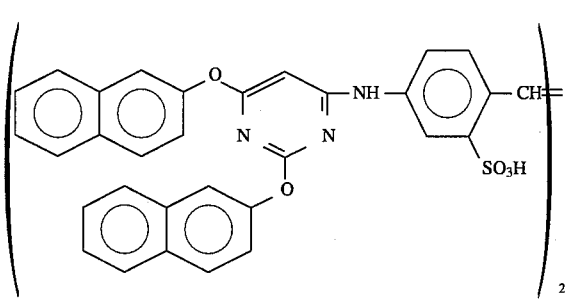

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3*a*,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

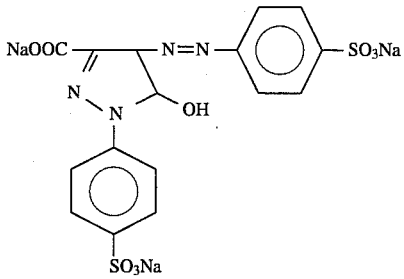

(10 mg/m²)

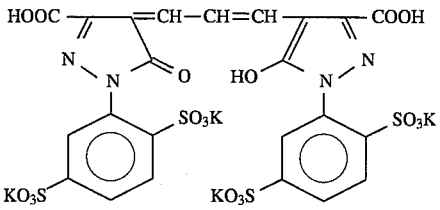

(10 mg/m²)

-continued

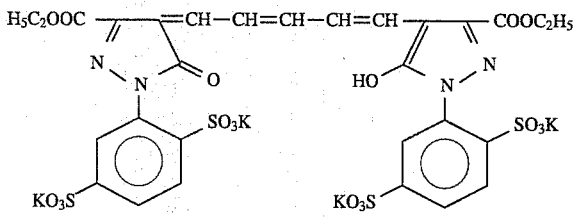

(40 mg/m²)

and

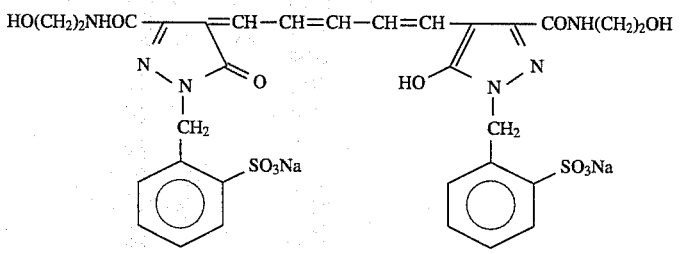

(20 mg/m²)

(Composition of Layers)

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer) | |
| The above-described silver chlorobromide emulsion A | 0.30 |
| Gelatin | 1.86 |
| Yellow coupler ($ExY_1$) | 0.82 |
| Image-dye stabilizer S | 0.25 |
| Solvent (Solv-3) | 0.18 |
| Solvent (Solv-7) | 0.18 |
| Image-dye stabilizer (Cpd-6) | 0.06 |
| Second Layer (Color-mix preventing layer) | |
| Gelatin | 0.99 |
| Color-mix inhibitor (Cpd-4) | 0.08 |
| Solvent (Solv-1) | 0.16 |
| Solvent (Solv-4) | 0.08 |
| Third Layer (Green-sensitive emulsion layer) | |
| Silver chlorobromide emulsions (cubic grains, 1:3 (Ag mol ratio) blend of large size emulsion B having average grain size of 0.55 μm and small size emulsion B having average grain size of 0.39 μm, each of whose deviation coefficient of grain size distribution is 0.10 and 0.08, respectively, each in which 0.8 mol % of AgBr was located at the surface of grains) | 0.12 |
| Gelatin | 1.24 |
| Magenta coupler (ExM) | 0.23 |
| Image-dye stabilizer (Cpd-1) | 0.03 |
| Image-dye stabilizer (Cpd-2) | 0.16 |
| Image-dye stabilizer (Cpd-3) | 0.02 |
| Image-dye stabilizer (Cpd-8) | 0.02 |
| Solvent (Solv-2) | 0.40 |
| Fourth Layer (Color-mix preventing layer) | |
| Gelatin | 1.58 |
| Ultraviolet-absorber (UV-1) | 0.47 |
| Color-mix inhibitor (Cpd-4) | 0.05 |
| Solvent (Solv-5) | 0.24 |

-continued

| | |
|---|---|
| Fifth Layer (Red-sensitive emulsion layer) | |
| Silver chlorobromide emulsions (cubic grains, 1:4 (Ag mol ratio) blend of large size emulsion C having average grain size of 0.58 μm and small size emulsion C having average grain size of 0.45 μm, each of whose deviation coefficient of grain size distribution is 0.09 and 0.11, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-1) | 0.03 |
| Image-dye stabilizer (Cpd-3) | 0.02 |
| Image-dye stabilizer (Cpd-5) | 0.18 |
| Image-dye stabilizer (Cpd-6) | 0.40 |
| Image-dye stabilizer (Cpd-7) | 0.05 |
| Solvent (Solv-6) | 0.14 |
| Sixth layer (Ultraviolet ray absorbing layer) | |
| Gelatin | 0.53 |
| Ultraviolet absorber (UV-1) | 0.16 |
| Color-mix inhibitor (Cpd-4) | 0.02 |
| Solvent (Solv-5) | 0.08 |
| Seventh layer (Protective layer) | |
| Gelatin | 1.33 |
| Acryl-modified copolymer of polyvinyl alcohol (modification degree: 17%) | 0.17 |
| Liquid paraffin | 0.03 |

($ExY_1$) Comparative yellow coupler
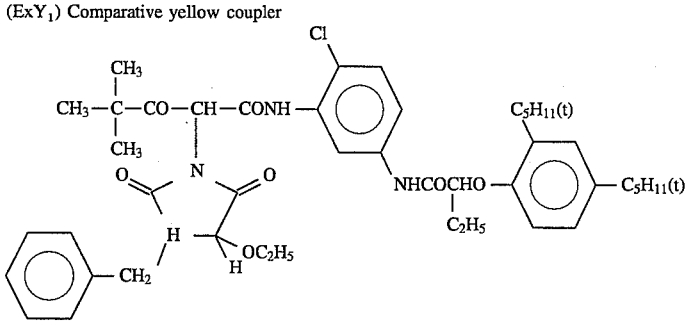
($ExY_2$) Comparative yellow coupler
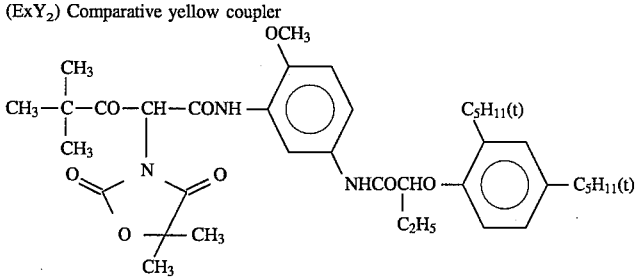
(ExM) Magenta coupler
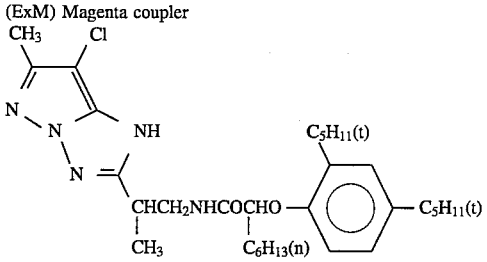
(ExC) Cyan coupler
Mixture (1:1:1 in molar ratio) of
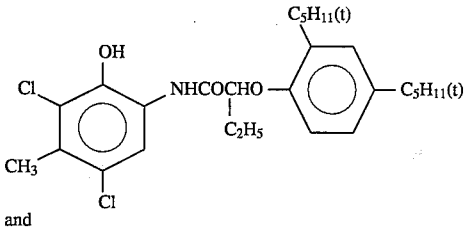
and
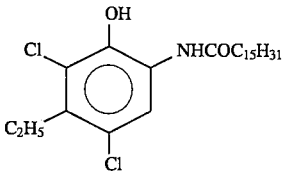
(Cpd-1) Image-dye stabilizer
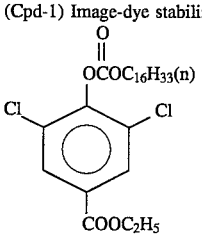

-continued
(Cpd-2) Image-dye stabilizer
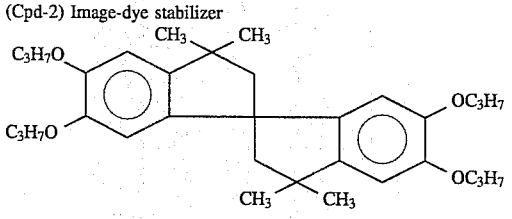
(Cpd-3) Image-dye stabilizer
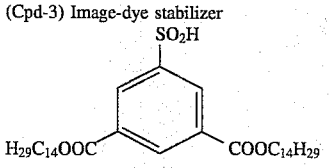
(Cpd-4) Image-dye stabilizer
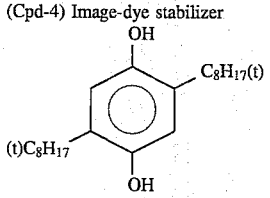
(Cpd-5) Image-dye stabilizer
Mixture (2:4:4 in weight ratio) of
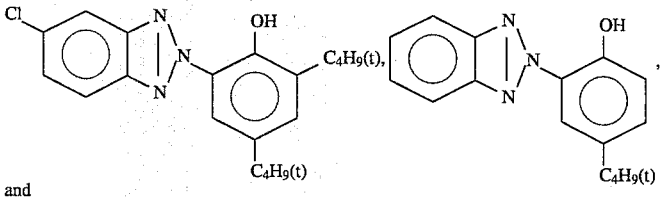
and
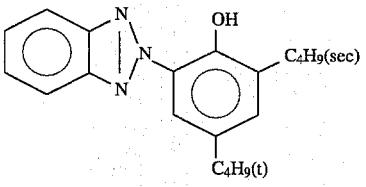
(Cpd-6) Image-dye stabilizer
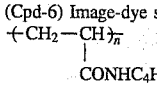
Average molecular weight: 60,000
(Cpd-7) Image-dye stabilizer
Mixture (1:1 in weight ratio) of
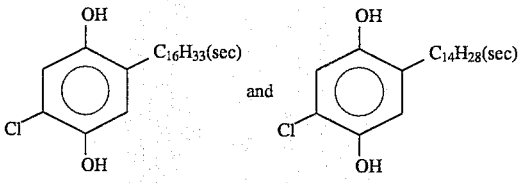
(Cpd-8) Image-dye stabilizer
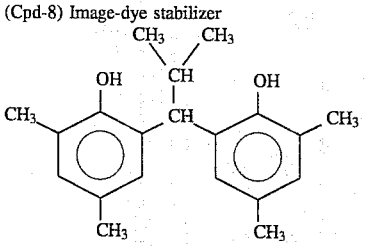

-continued
(Cpd-9) Antiseptic
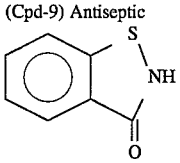
(Cpd-10) Antiseptic
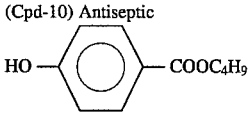
(UV-1) Ultraviolet ray absorber
Mixture (4:2:4 in weight ratio) of
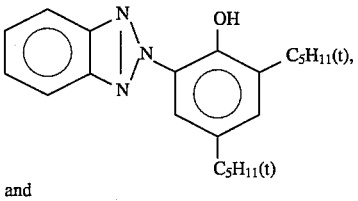
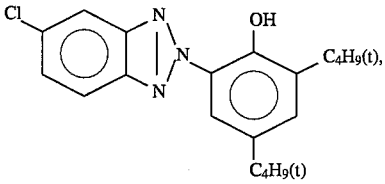
and
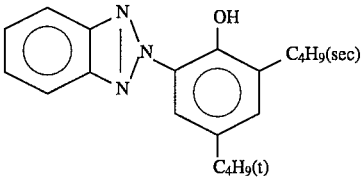
(Solv-1) Solvent
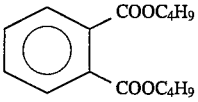
(Solv-2) Solvent
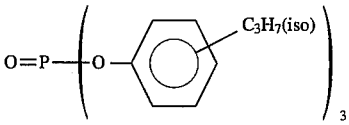
and
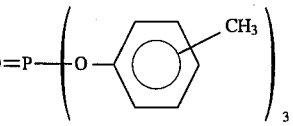
(Solv-3) Solvent
$O{=}P{\leftarrow}O{-}C_9H_{19}(iso))_3$
(Solv-4) Solvent
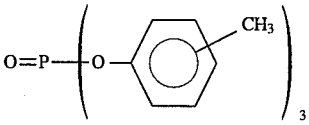
(Solv-5) Solvent
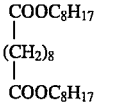

-continued (Solv-6) Solvent
Mixture (80:20 in volume ratio) of

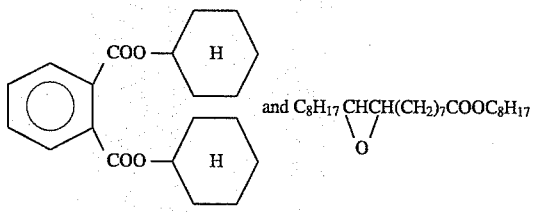

(Solv-7) Solvent
$C_8H_{17}CHCH(CH_2)_7COOC_8H_{17}$
O

Samples 202 to 266 were prepared in the same manner as Sample 201, except that the yellow coupler and image-dye stabilizer S represented by formula (II) or (III) in the first layer were changed as shown in Table 2. Then, each of samples was subjected to a gradation exposure to light through three color separated filter for sensitometry using a sensitometer (FWH model made by Fuji Photo Film Co., Ltd., the color temperature of light source was 3200° K.). At that time, the exposure was carried out in such a manner that the exposure amount was 250 CMS with the exposure time being 0.1 sec.

After exposure to light, each sample was subjected to the same processing as in Example 1 using a paper processor.

After processing samples were subjected to the following test.

(Light-fastness)

Each sample was irradiated with light for five days using a Xenon fade meter (100,000 Lux). Light-fastness is expressed in a ratio (%) of density (D) after the light irradiation to an initial density (D=1.0).

(Color formation)

The maximum reflection density of yellow dye-image after processing was determined.

Results are shown in Table 2.

TABLE 2

| Sample NO. | Yellow Coupler | Image-dye Stabilizer S | Maximum Reflection Density | Light-Fastness (%) | Remarks |
|---|---|---|---|---|---|
| 201 | $ExY_1$ | — | 2.02 | 78 | Comparative Example |
| 202 | $ExY_2$ | — | 2.04 | 75 | " |
| 203 | Y-1 | — | 2.30 | 74 | " |
| 204 | Y-9 | — | 2.32 | 74 | " |
| 205 | Y-29 | — | 2.29 | 73 | " |
| 206 | Y-30 | — | 2.31 | 73 | " |
| 207 | Y-41 | — | 2.20 | 72 | " |
| 208 | $ExY_1$ | II-13 | 1.89 | 81 | " |
| 209 | " | III-1 | 1.87 | 82 | " |
| 210 | " | III-12 | 1.87 | 81 | " |
| 211 | " | III-17 | 1.86 | 81 | " |
| 212 | " | II-17 | 1.89 | 81 | " |
| 213 | " | II-39 | 1.87 | 82 | " |
| 214 | " | II-44 | 1.89 | 81 | " |
| 215 | " | II-79 | 1.89 | 82 | " |
| 216 | $ExY_2$ | II-9 | 1.88 | 78 | " |
| 217 | " | III-4 | 1.87 | 78 | " |
| 218 | " | II-26 | 1.87 | 78 | " |
| 219 | " | II-90 | 1.88 | 78 | " |
| 220 | Y-1 | II-16 | 2.30 | 82 | This Invention |
| 221 | Y-4 | " | 2.19 | 83 | " |
| 222 | Y-10 | " | 2.28 | 83 | " |
| 223 | Y-29 | " | 2.29 | 82 | " |
| 224 | Y-31 | " | 2.31 | 82 | " |
| 225 | Y-43 | " | 2.30 | 82 | " |
| 226 | Y-45 | " | 2.21 | 83 | " |
| 227 | Y-1 | III-17 | 2.28 | 82 | " |
| 228 | Y-12 | " | 2.17 | 83 | " |
| 229 | Y-29 | " | 2.28 | 82 | " |
| 230 | Y-41 | " | 2.20 | 83 | " |
| 231 | Y-1 | II-26 | 2.31 | 82 | " |
| 232 | Y-12 | " | 2.19 | 83 | " |
| 233 | Y-29 | " | 2.32 | 82 | " |
| 234 | Y-1 | II-13 | 2.27 | 82 | This Invention |
| 235 | " | II-15 | 2.28 | 82 | " |
| 236 | " | III-1 | 2.32 | 82 | " |
| 237 | " | III-4 | 2.30 | 82 | " |

TABLE 2-continued

| Sample NO. | Yellow Coupler | Image-dye Stabilizer S | Maximum Reflection Density | Light-Fastness (%) | Remarks |
|---|---|---|---|---|---|
| 238 | " | III-12 | 2.30 | 83 | " |
| 239 | " | II-17 | 2.29 | 83 | " |
| 240 | " | II-26 | 2.28 | 82 | " |
| 241 | " | II-35 | 2.27 | 82 | " |
| 242 | " | II-40 | 2.28 | 82 | " |
| 243 | " | II-42 | 2.30 | 81 | " |
| 244 | " | II-73 | 2.29 | 82 | " |
| 245 | Y-29 | II-10 | 2.28 | 82 | " |
| 246 | " | II-16 | 2.28 | 82 | " |
| 247 | " | III-5 | 2.28 | 82 | " |
| 248 | " | III-13 | 2.27 | 83 | " |
| 249 | " | II-23 | 2.29 | 82 | " |
| 250 | " | II-39 | 2.28 | 82 | " |
| 251 | " | II-51 | 2.28 | 81 | " |
| 252 | " | II-90 | 2.30 | 82 | " |
| 253 | Y-41 | II-13 | 2.19 | 83 | " |
| 254 | " | III-17 | 2.20 | 83 | " |
| 255 | " | II-17 | 2.19 | 83 | " |
| 256 | " | II-36 | 2.18 | 83 | " |
| 257 | " | II-79 | 2.20 | 83 | " |
| 258 | Y-43 | II-1 | 2.30 | 82 | " |
| 259 | " | III-4 | 2.29 | 82 | " |
| 260 | " | II-40 | 2.29 | 83 | " |
| 261 | Y-44 | II-13 | 2.28 | 83 | " |
| 262 | " | III-13 | 2.29 | 82 | " |
| 263 | " | II-40 | 2.29 | 83 | " |
| 264 | Y-59 | II-13 | 2.20 | 82 | " |
| 265 | " | III-5 | 2.22 | 82 | " |
| 266 | " | II-40 | 2.21 | 83 | " |

As is apparent from the results in Table 2, with respect to Comparative Samples 208 to 224, in which compounds represented by formula (II) or (III) were used in combination with the Comparative coupler $ExY_1$ or ExY2, the light-fastness was certainly improved, but the spectral absorption characteristics was remained not being improved such that the color formation was reversely deteriorated compared with the Samples 201 to 207 wherein the compound represented by formula (II) or (III) was not used.

On the contrary, when a yellow coupler represented by formula (I) and a compound represented by formula (II) or (III) are simultaneously used according to this invention, yellow dyes excellent in spectral absorption characteristics are obtained at the same time that the light-fastness is improved and the color formation is not deteriorated.

Separately, Samples were processed in a continuous processing (running test) until the replenishing amount of color developer reached twice the volume of tank, and the similar effect to the above was confirmed by the similar test of processed sample.

Example 3

Samples 102 to 112 were prepared in the same manner as Sample 101 in Example 1 described in the published document of JP-A No. 854/1990, except that Yellow coupler represented by formula (I) and Image-dye stabilizers S represented by formula (II) or (III) of the present invention were used instead of Coupler C-5 in the 12th layer and Coupler C-7 in the 13th layer,respectively, as shown in Table 3. Samples were processed, after exposed to blue light of gradation, in the same procedure in Example 1 of said published document, and it was found that yellow colored dye of sample prepared by utilizing yellow coupler of this invention was excellent in spectral absorption characteristics without the deterioration of color formation due to using Image-dye stabilizer S.

The light-fastness of yellow dye of each processed Sample after an irradiation of light for 10 days in a Xenon fade meter was determined and expressed in a percentage of density after irradiation to the initial density 3.5.

Results are shown in Table 3.

TABLE 3

| Sample NO. | Yellow Coupler | Image-dye Stabilizer S (0.2 g/m$^2$) | Residual Ratio of Yellow Dye Density (%) | Remarks |
|---|---|---|---|---|
| 101 | C-5, C-7 | — | 77 | Comparative Example |
| 102 | " | II-1 | 76 | " |
| 103 | " | III-1 | 76 | " |
| 104 | " | II-44 | 75 | " |
| 105 | Y-6 | II-1 | 79 | This Invention |
| 106 | " | II-16 | 78 | " |
| 107 | " | III-1 | 79 | " |
| 108 | " | II-51 | 78 | " |
| 109 | Y-17 | II-16 | 79 | " |

TABLE 3-continued

| Sample NO. | Yellow Coupler | Image-dye Stabilizer S (0.2 g/m²) | Residual Ratio of Yellow Dye Density (%) | Remarks |
|---|---|---|---|---|
| 110 | " | III-17 | 78 | " |
| 111 | " | II-17 | 79 | " |
| 112 | " | II-40 | 79 | " |

Thus, the yellow color-formed dye not only excellent in spectral absorption characteristics but also having an improved light-fastness without lowering color forming property can be obtained by the combination use of yellow coupler represented by formula (I) and a compound represented by formula (II) or (III) of the present invention.

Example 4

Samples B to G were prepared in the same manner as Sample A3 in Example 2 described in the published document of JP-A No. 158431/1989, except that Yellow coupler represented by formula (I) and Image-dye stabilizers S represented by formula (II) or (III) of the present invention were used instead of yellow coupler ExY-1 in the 11th layer and the 12th layer, respectively, as shown in Table 4. Samples were processed, after exposed to blue light of gradation, in the same procedure in Example 1 of said published document, and it was found that yellow colored dye of sample prepared by utilizing yellow coupler of this invention was excellent in spectral absorption characteristics without the deterioration of color formation due to using Image-dye stabilizer S.

The light-fastness of yellow dye of each processed Sample after an irradiation of light for 10 days in a Xenon fade meter was determined and expressed in a percentage of density after irradiation to the initial density 1.5.

Results are shown in Table 4.

TABLE 4

| Sample NO. | Yellow Coupler | Image-dye Stabilizer S (0.15 g/m²) | Residual Ratio of Yellow Dye Density (%) | Remarks |
|---|---|---|---|---|
| A3 | ExY-1 | — | 77 | Comparative Example |
| B | Y-1 | II-1 | 83 | This Invention |
| C | " | III-17 | 84 | " |
| D | " | II-44 | 84 | " |
| E | Y-29 | II-16 | 84 | " |
| F | " | III-1 | 84 | " |
| G | " | II-17 | 84 | " |

Thus, the yellow color-formed dye not only excellent in spectral absorption characteristics but also having an improved light-fastness without lowering color forming property can be obtained by the combination use of yellow coupler represented by formula (I) and a compound represented by formula (II) or (III) of the present invention.

Example 5

Photosensitive material samples 2 to 7 were prepared in the same manner as photosensitive material Sample 1 in Example 1 described in the published document of JP-A No. 93641/1990, except that Yellow coupler represented by formula (I) and Image-dye stabilizers S represented by formula (II) or (III) of the present invention were used instead of yellow coupler (Ex-9)in the in the 11th layer, 11th layer, and 13th layer, respectively, as shown in Table 5. Samples were processed, after exposed to blue light of gradation, in the same procedure in Example 1 of said published document, and it was found that yellow colored dye of sample prepared by utilizing yellow coupler of this invention was excellent in spectral absorption characteristics without the deterioration of color formation due to using Image-dye stabilizer S.

The light-fastness of yellow dye of each processed Sample after an irradiation of light for 10 days in a Xenon fade meter was determined and expressed in a percentage of density after irradiation to the initial density 1.5.

Results are shown in Table 5.

TABLE 5

| Sample NO. | Yellow Coupler | Image-dye Stabilizer S (0.20 g/m²) | Residual Ratio of Yellow Dye Density (%) | Remarks |
|---|---|---|---|---|
| PM*1 | Ex-9 | — | 88 | Comparative Example |
| PM*2 | Y-1 | II-1 | 94 | This Invention |
| PM*3 | " | III-1 | 93 | " |
| PM*4 | " | II-42 | 94 | " |

TABLE 5-continued

| Sample NO. | Yellow Coupler | Image-dye Stabilizer S (0.20 g/m²) | Residual Ratio of Yellow Dye Density (%) | Remarks |
|---|---|---|---|---|
| PM*5 | Y-14 | II-16 | 94 | " |
| PM*6 | " | III-17 | 95 | " |
| PM*7 | " | II-51 | 95 | " |

Note;
*PM: Photosensitive Material

Thus, the yellow color-formed dye not only excellent in spectral absorption characteristics but also having an improved light-fastness without lowering color forming property can be obtained by the combination use of yellow coupler represented by formula (I) and a compound represented by formula (II) or (III) of the present invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having at least one photosensitive silver halide emulsion layer, and at least one non-photosensitive hydrophilic colloid layer on a support, which comprises, in at least one of said photosensitive silver halide emulsion layer, at least one coupler selected from an acylacetamide yellow dye-forming coupler represented by the following formula (I) and at least one compound represented by formula (IIE) or formula (II-G):

Formula (I)

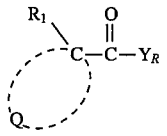

wherein

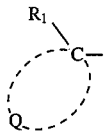

represents

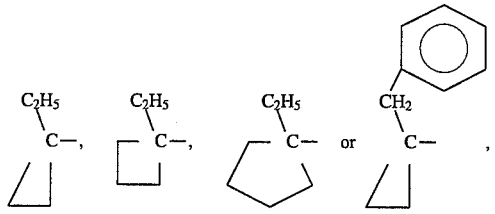

and $Y_R$ represents a residue remaining after removing the acyl group

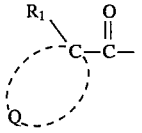

at the α position of the acetamide moiety from the acylacetamide yellow dye-forming coupler represented by formula (I);

Formula (IIE)

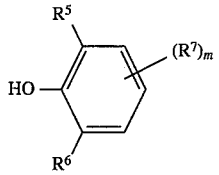

wherein $R^5$ and $R^6$ each represent an alkyl group, $R^7$ represents an alkyl group, —$NHR^8$ (wherein $R^8$ represents a monovalent organic group), or —$COOR^9$ (wherein $R^9$ represents a hydrogen atom or a monovalent organic group), and m represents an integer of 0 to 3;

(Formula (IIG)

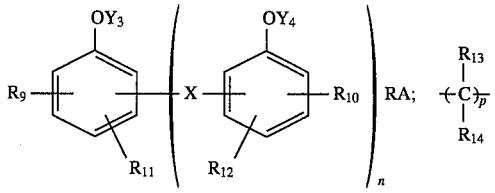

wherein $R_9$, $R_{10}$, $R_{11}$, and $R_{12}$ each represent a hydrogen atom or an alkyl group having 1 to 18 carbon atoms, the total of the carbon atoms of $R_9$, $R_{10}$, $R_{11}$, and $R_{12}$ is 32 or less, $Y_3$ and $Y_4$ each represent a hydrogen atom, an alkyl group, an aryl group, a heterocyclic group, an acyl group, a sulfonyl group, or a silyl group, X represents a single bond, an oxygen atom, a sulfur atom, a sulfonyl group, or RA, wherein $R_{13}$ and $R_{14}$ each represent a hydrogen atom or an alkyl group having 1 to 10 carbon atoms, p is an integer of 1 to 3, n is 1 or 2, when p is 2 or 3, the groups $R_{13}$ or the groups $R_{14}$ may be the same or different.

2. The silver halide color photographic material as claimed in claim 1, wherein the acetylacetamide yellow dye-forming coupler is selected from a compound represented by the following formula (Y):

Formula (Y)

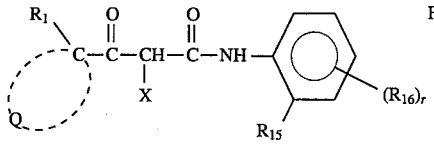

wherein

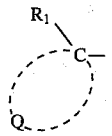

is as defined in claim 1, $R_{15}$ represents a hydrogen atom, a halogen atom, an alkoxy group, an aryloxy group, an alkyl group, or an amino group, $R_{16}$ represents a group capable of substitution onto a benzene ring, X represents a hydrogen atom or a group capable of being released upon a coupling reaction thereof with the oxidized product of an aromatic primary amine developing agent, r is an integer of 0 to 4, and when r is 2 or more, the $R_{16}$ groups may be the same or different.

3. The silver halide color photographic material as claimed in claim 2, wherein X in formula (Y) represents a heterocyclic group bonded to the coupling active site through the nitrogen atom or an aryloxy group.

4. The silver halide color photographic material as claimed in claim 2, wherein $R_3$ in formula (Y) represents a halogen atom, an alkoxy group, an alkoxycarbonyl group, an aryloxycarbonyl group, a carbonamido group, a sulfonamido group, a carbamoyl group, or a sulfamoyl group.

5. The silver halide color photographic material as claimed in claim 2, wherein $R_{15}$ is selected from the group consisting of F, Cl, Br, I, $CH_3O$—, 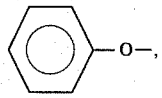 —O—, $CH_3O$— 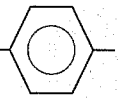 —O—, $CH_3$—, $C_2H_5$—, i-$C_3H_7$—, t-$C_4H_9$—, $CH_3OCH_2CH_2O$—, $CF_3$—, $(CH_3)_2N$—,

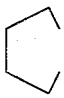 N— n-$C_4H_9O$—, n-$C_{14}H_{29}O$—, n-$C_{16}H_{33}O$—,

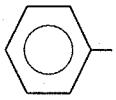 —$CH_2O$—, and n-$C_{12}H_{25}O$—.

6. The silver halide color photographic material as claimed in claim 2, wherein $R_{16}$ is selected from the group consisting of F, Cl, Br, I, $CH_3O$—, $C_2H_5O$—, n-$C_{12}H_{25}O$—, $CH_3$, t-$C_4H_9$—, —$COOCH_3$, $COOC_2H_5$, —$COOC_4H_9$-$^n$, —$COOC_{12}H_{25}$-$^n$, —$OCH_2CH(C_6H_{13}$-$^n)C_8H_{17}$-$^n$ —$COOCH(CH_3)COOC_{12}H_{25}$-$^n$, —$COOCH(C_4H_9$-$^n)COOC_{12}H_{29}$-$^n$, -continued

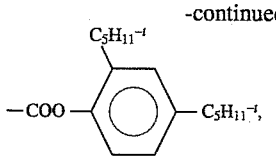
—COO— $C_5H_{11}$-$^t$,

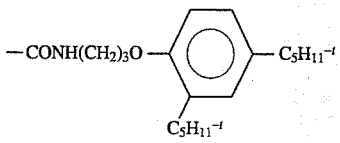
—$CONH(CH_2)_3O$— $C_5H_{11}$-$^t$

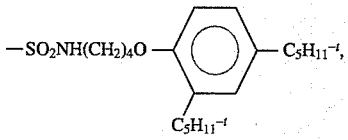
—$SO_2NH(CH_2)_4O$— $C_5H_{11}$-$^t$,

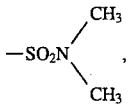
—$SO_2N(CH_3)_2$, —$SO_2NHCOC_2H_5$, —$SO_2NHC_{16}H_{33}$-$^n$,

—$NHCOC_{13}H_{27}$-$^n$, —$NHCOC_{15}H_{31}$-$^n$,

—$NHCOC_{17}H_{35}$-$^n$ —$NHCO(C_6H_{13}$-$^n)CH$—$C_8H_{17}$-$^n$,

—$NHCO(CHCHCH_2C_4H_9$-$^t)CH(CH_3)CH_2CH_2CH(CH_3)CH_2C_4H_9$-$^t$

—$NHCO(CH_3)CHCH_2SO_2C_{16}H_{33}$-$^n$

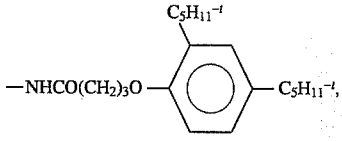
—$NHCO(CH_2)_3O$— $C_5H_{11}$-$^t$,

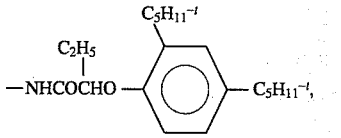
—$NHCO(C_2H_5)CHO$— $C_5H_{11}$-$^t$,

—$NHCO(C_3H_7$-$^i)CHSO_2C_{16}H_{33}$-$^n$, —$NHSO_2C_{12}H_{25}$-$^n$,

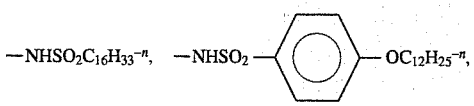
—$NHSO_2C_{16}H_{33}$-$^n$, —$NHSO_2$— —$OC_{12}H_{25}$-$^n$,

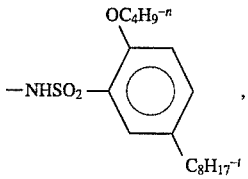
—$NHSO_2$— , —$SO_2NHCH_3$,

-continued

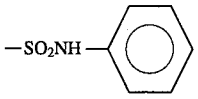

, $-OCOC_{11}H_{23}{}^{-n}$, $-OSO_2C_{12}H_{25}{}^{-n}$, and $-NHCOOC_{12}H_{25}{}^{-n}$.

7. The silver halide color photographic material as claimed in claim 1, wherein the acylacetamide yellow dye-forming coupler represented by formula (I) is used in an amount of 0.1 to 1.0 mol per mol of the silver halide in the layer where the yellow coupler is used.

8. The silver halide color photographic material as claimed in claim 1, wherein the compound represented by formula (IIE) or formula (IIG) is contained in an amount of 0.01 to 2.0 mol per mol of the yellow coupler represented by formula (I).

9. The silver halide color photographic material as claimed in claim 1, wherein the compound represented by formula (IIE) or formula (IIG) is co-emulsified with the yellow coupler represented by formula (I).

10. The silver halide color photographic material as claimed in claim 1, wherein the compound represented by formula (IIE) or formula (IIG) is adjacent to the layer containing yellow coupler represented by formula (I).

11. The silver halide color photographic material as claimed in claim 1, wherein the silver halide emulsion of the said silver halide color photographic material comprises a silver chlorobromide or silver chloride having a silver chloride content of 90 mol % or more.

12. The silver halide color photographic material as claimed in claim 1, wherein

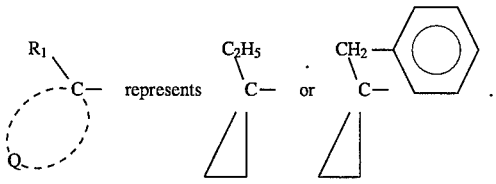

* * * * *